US007231954B2

(12) United States Patent
Green

(10) Patent No.: US 7,231,954 B2
(45) Date of Patent: Jun. 19, 2007

(54) BARRIER

(76) Inventor: Craig S. Green, 650 Nenno Ave., Placentia, CA (US) 92870

( * ) Notice: Subject to any disclaimer, the term of this patent is extended or adjusted under 35 U.S.C. 154(b) by 28 days.

(21) Appl. No.: 10/728,327

(22) Filed: Dec. 4, 2003

(65) Prior Publication Data

US 2004/0112550 A1 Jun. 17, 2004

Related U.S. Application Data

(60) Provisional application No. 60/431,413, filed on Dec. 5, 2002.

(51) Int. Cl.
*A47G 7/00* (2006.01)

(52) U.S. Cl. ..... 160/350; 160/135; 135/114; 52/63

(58) Field of Classification Search ..... 160/135, 160/351, 350, 377, 379, 330; 135/121, 114, 135/149; 52/63; 248/168, 170, 166, 163.1; 40/607.1, 607.9
See application file for complete search history.

(56) References Cited

U.S. PATENT DOCUMENTS 645,656 A * 3/1900 Wynkoop ..... 135/114
1,315,497 A * 9/1919 Higdon et al. ..... 135/157
1,449,894 A * 3/1923 Dial ..... 135/98
2,571,382 A * 10/1951 Raven ..... 403/190
2,984,444 A * 5/1961 Lewis ..... 248/166
3,217,722 A * 11/1965 Heise ..... 52/63
3,591,116 A * 7/1971 Dalum ..... 248/172
4,691,892 A * 9/1987 Grewe et al. ..... 248/624
5,340,066 A * 8/1994 Ditch ..... 248/170
5,489,077 A * 2/1996 Stoudt ..... 248/188.7
5,553,648 A * 9/1996 Goharjou ..... 160/135
6,000,175 A * 12/1999 Gale et al. ..... 52/63
6,370,803 B1 * 4/2002 Burquest ..... 40/607.04
6,755,381 B1 * 6/2004 Levin et al. ..... 248/163.1

* cited by examiner

*Primary Examiner*—Blair M. Johnson
(74) *Attorney, Agent, or Firm*—Knobbe, Martens, Olson & Bear LLP

(57) ABSTRACT

A portable barrier panel for providing privacy to a screened area comprises a plurality of vertical support tubes. The portable barrier panel further comprises a plurality of elongate legs having an adjustable length. The elongate legs attached to a lower portion of the vertical support tubes, such that an angle α exists between the elongate leg and the vertical support tube axis. The angle α is adjustable. The portable barrier panel further comprises an elongate horizontal framing member having first and second ends that are supported by top two different vertical support tubes. The portable barrier panel further comprises an opaque curtain mounted to the horizontal framing member and at least one of the vertical support tubes.

27 Claims, 25 Drawing Sheets

BARRIER

PRIORITY APPLICATION

This application claims the benefit of U.S. Provisional Patent Application 60/431,413, filed 5 Dec. 2002, the entire contents of which is hereby incorporated herein by reference.

FIELD OF THE INVENTION

The present invention relates generally to a barrier, and relates more specifically to a portable, adjustable barrier that can be used to provide privacy to a cordoned off area.

BACKGROUND OF THE INVENTION

A wide variety of barriers are used for many purposes, including for providing privacy to, and/or restricting entry to, a cordoned off area. For example, homeowners often erect fences around a portion of their property to provide a private yard that is separated from neighboring parcels. Such fencing often comprises a permanent, immovable structure that is anchored into a grounded foundation, thereby allowing it to withstand adverse weather conditions, or minor impacts from objects. Temporary barriers that are not permanently anchored in the ground, and which can be moved from one location to another, have also been developed. Temporary barrier systems provide many of the advantages of permanent fencing, while its portability allows it to be used in applications such as creating indoor and/or outdoor compounds, securing construction/roofing sites, and managing outdoor special events.

SUMMARY OF THE INVENTION

Although temporary barrier systems provide many of the advantages of permanent barriers, conventional temporary barrier systems suffer from several disadvantages. For example, conventional temporary barrier systems are susceptible to toppling in windy conditions, or when placed on uneven terrain. Furthermore, many conventional temporary barrier systems do not provide privacy, which is often advantageous. Finally, conventional temporary barrier systems are often cumbersome and difficult to transport, and are difficult to construct and collapse. To address these concerns, an improved portable barrier system has been developed.

In accordance with one embodiment of the present invention, a portable barrier panel for providing privacy to a screened area comprises a plurality of vertical support tubes. The vertical support tubes have an elongate axis, a lower portion and an upper portion opposite the lower portion. The portable barrier panel further comprises a plurality of elongate legs having an adjustable length. The elongate legs attach to the lower portion of the vertical support tubes, such that an angle $\alpha$ exists between the elongate leg and the vertical support tube axis. The angle $\alpha$ is adjustable. The portable barrier panel further comprises a top elbow assembly mounted on the upper portion of the vertical support tubes. The top elbow assembly has a side tube holder positioned in a substantially perpendicular configuration with respect to the vertical support tube axis. The side tube holder can be rotated around the vertical support tube axis. The portable barrier panel further comprises an elongate horizontal framing member having first and second ends. The first and second ends are supported by side tube holders that form a part of top elbow assemblies that are mounted to two different vertical support tubes. The portable barrier panel further comprises an opaque curtain mounted to the horizontal framing member and at least one of the vertical support tubes.

In accordance with another embodiment of the present invention, an apparatus comprises a frame that includes n horizontal framing members having first and second ends, and n+1 vertical support posts. The vertical support posts are positioned to support the ends of the horizontal framing members. The value n is an integer greater than or equal to one. The apparatus further comprises a leg assembly mounted to and supporting each of the n+1 vertical support posts. The leg assembly has a plurality of elongate legs with an adjustable length. The elongate legs are attached to the vertical support post such than an angle $\alpha$ exists between the elongate leg and the vertical support post. The angle $\alpha$ is adjustable. The apparatus further comprises an opaque curtain supported by the frame.

In accordance with another embodiment of the present invention, a kit comprises a plurality of vertical support tubes having a lower portion and an upper portion. A plurality of elongate legs are attached to the lower portion of the vertical support tubes at an adjustable angle. The elongate legs have an adjustable length. The kit further comprises a plurality of horizontal framing members configured to be mounted to the upper portion of the vertical support tubes. The kit further comprises a plurality of opaque curtains configured to be at least partially supported by the horizontal framing members. The opaque curtains form a plurality of barrier panels that are rotatable with respect to each other. The kit further comprises an instruction sheet containing instructions for assembling the barrier panels. The kit further comprises a storage bag capable of holding the vertical support tubes, the horizontal framing members, and the instruction sheet.

In accordance with another embodiment of the present invention, a portable barrier system for providing an enclosed and covered area comprises a plurality of enclosure side panels. The system further comprises a plurality of vertical support posts that have a lower portion and an upper portion opposite the lower portion. The system further comprises a plurality of elongate legs having an adjustable length. The elongate legs are attached to the lower portion of the vertical support posts. An angle $\alpha$ exists between the elongate leg and the vertical support post. The angle $\alpha$ is adjustable. The system further comprises a top elbow assembly mounted on the upper support portion of the vertical support posts. The top elbow assembly includes a side tube holder positioned in a substantially perpendicular configuration with respect to the vertical support post. The top elbow assembly also includes an inclined roof support holder positioned in an inclined orientation with respect to the side tube holder. The system further comprises a roof support member that is supported by two inclined roof support holders. The roof support member forms a roof apex at an elevation above an elevation of the upper portion of the vertical support posts. The system further comprises a flexible roofing material overlaying the roof support member and forming an enclosed and covered area within the enclosure side panels.

BRIEF DESCRIPTION OF THE DRAWINGS

Exemplary embodiments of the portable barrier system described herein are illustrated in the accompanying drawings, which are for illustrative purposes only. The drawings comprise the following figures, in which like numerals indicate like parts.

DETAILED DESCRIPTION OF PREFERRED EMBODIMENTS

Introduction.

As set forth above, an improved portable barrier system has been developed that improves upon conventional temporary fencing systems. The various embodiments of the improved portable barrier system described herein can be used in a wide variety of applications. For example, certain embodiments are particularly well-adapted for use as a privacy shield by public authorities, and/or as a barrier for crowd control at public events.

Figure 1:
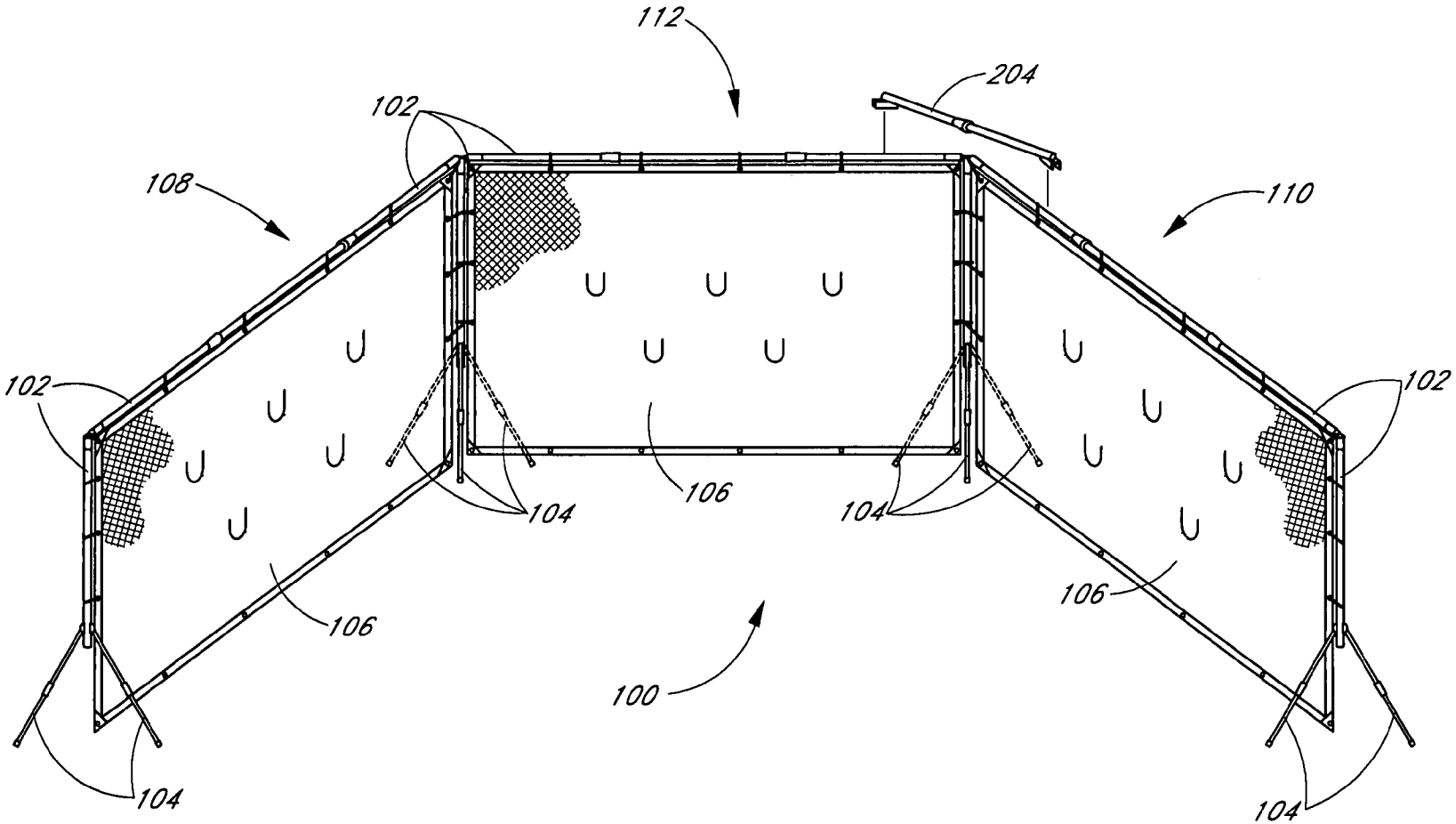
FIG. 1 is a side perspective view of an exemplary embodiment of an assembled portable barrier system.

An exemplary embodiment of an adjustable, portable barrier system 100 is illustrated in FIG. 1. The portable barrier 100 includes a frame 102 that is supported by a plurality of adjustable legs 104. The frame 102 supports one or more opaque curtains 106. For example, in the embodiment illustrated in FIG. 1, the frame 102 supports three adjustable curtains 106 that form a first end panel 108, a second end panel 110, and an intermediate panel 112. In other embodiments, the barrier system 100 includes fewer than three panels or greater than three panels, thereby allowing several different barrier system configurations to be created.

Figure 2:
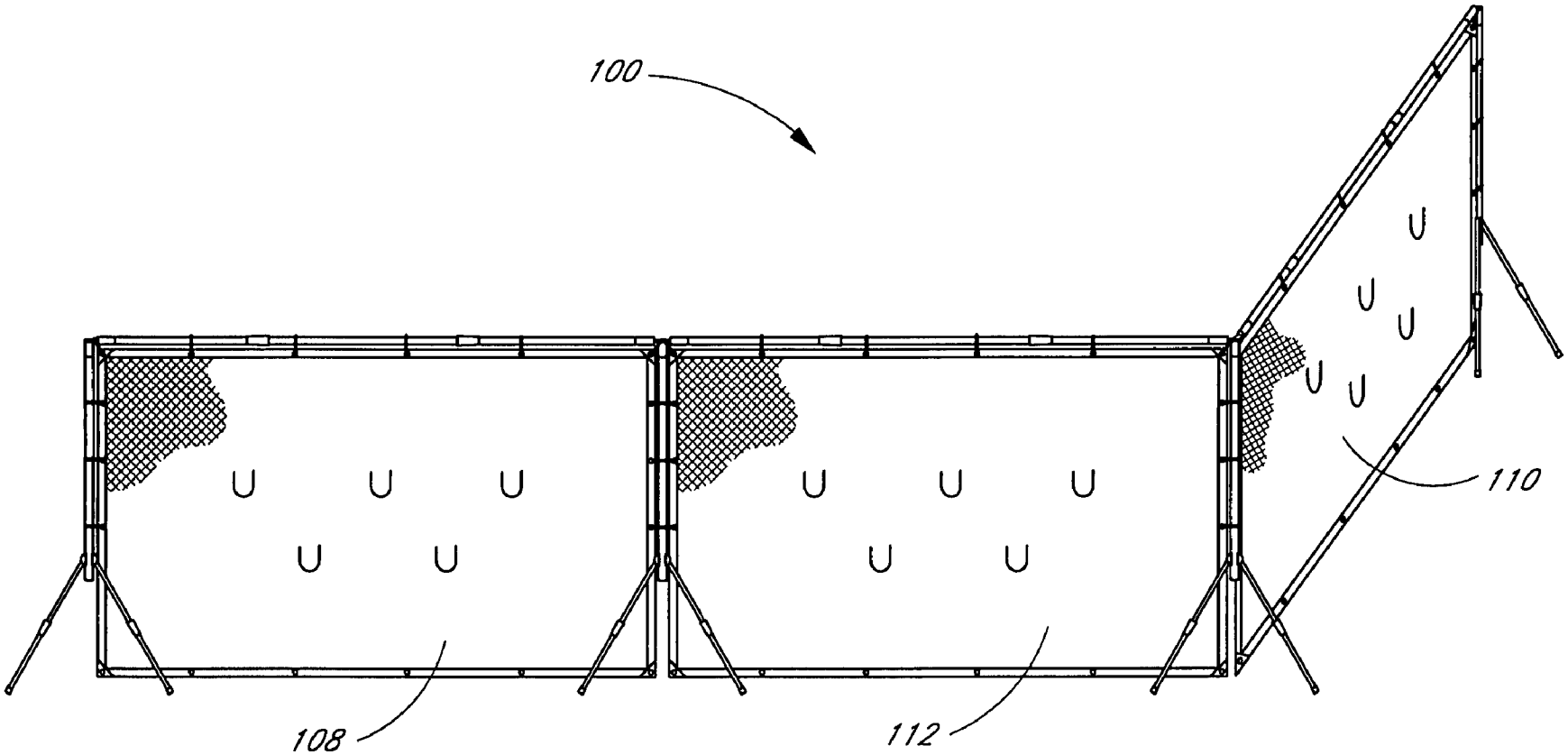
FIG. 2 is an overhead perspective view of the barrier system of FIG. 1, positioned in an "L"-shaped configuration.
Figure 3:
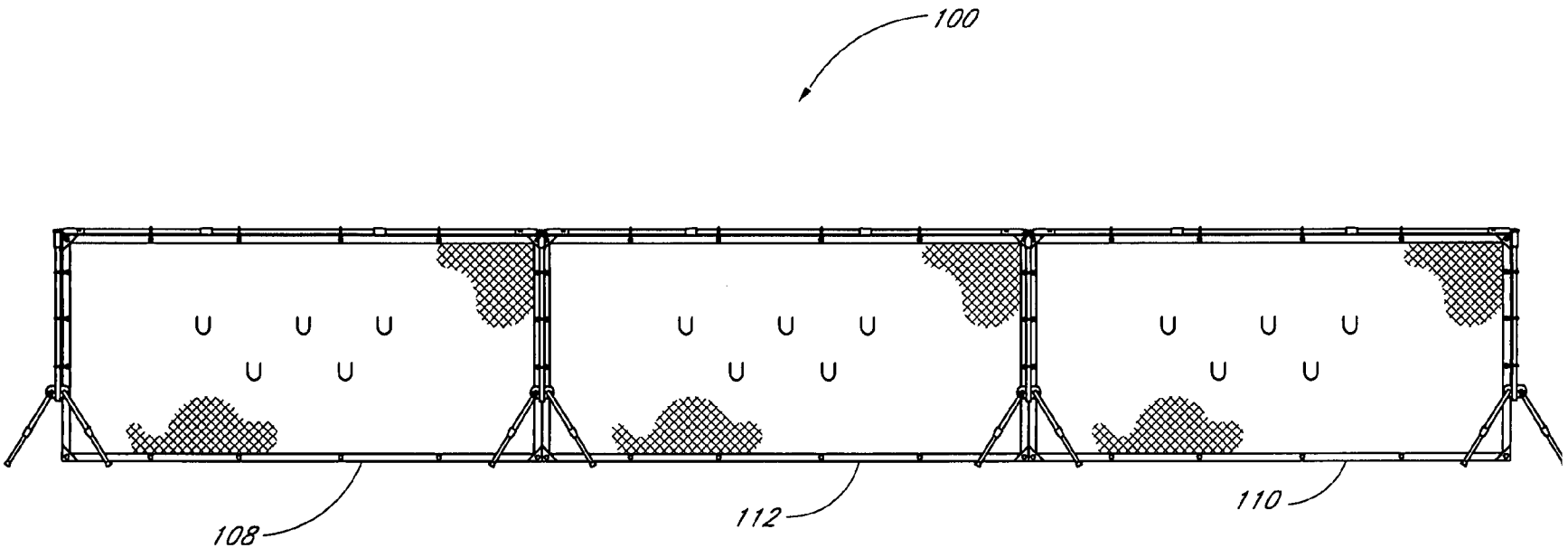
FIG. 3 is a side view of the barrier system of FIG. 1, having a parallel configuration.
Figure 4:
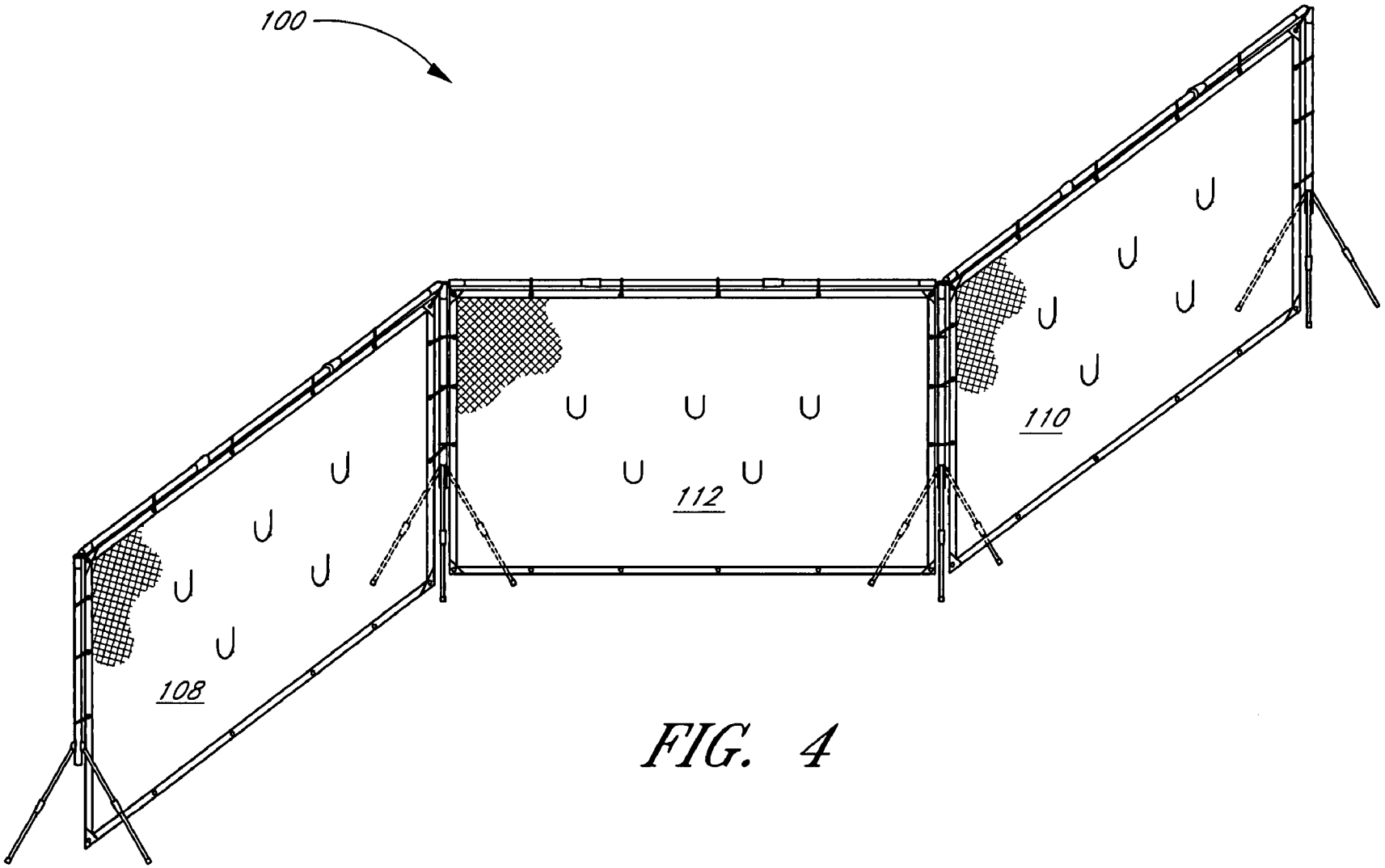
FIG. 4 is a side perspective view of the barrier system of FIG. 1, positioned in a zigzag configuration.

As will be described in greater detail below, the panels 108, 110, 112 are generally rotatable with respect to each other, thus allowing the barrier system 100 to be deployed in a wide variety of different configurations. For example, FIG. 2 illustrates the portable barrier system 100 of FIG. 1 in an "L"-shaped configuration, with the second end panel 110 oriented substantially perpendicular to both the first end panel 108 and the intermediate panel 112. As another example, FIG. 3 illustrates the portable barrier system 100 of FIG. 1 in a linear configuration, with all of the panels 108, 110, 112 oriented substantially parallel. Still another configuration is illustrated in FIG. 4, wherein the portable barrier system 100 has been positioned in a zigzag orientation. Several other configurations exist, including configurations with fewer than three panels or greater than three panels.

Figure 5:
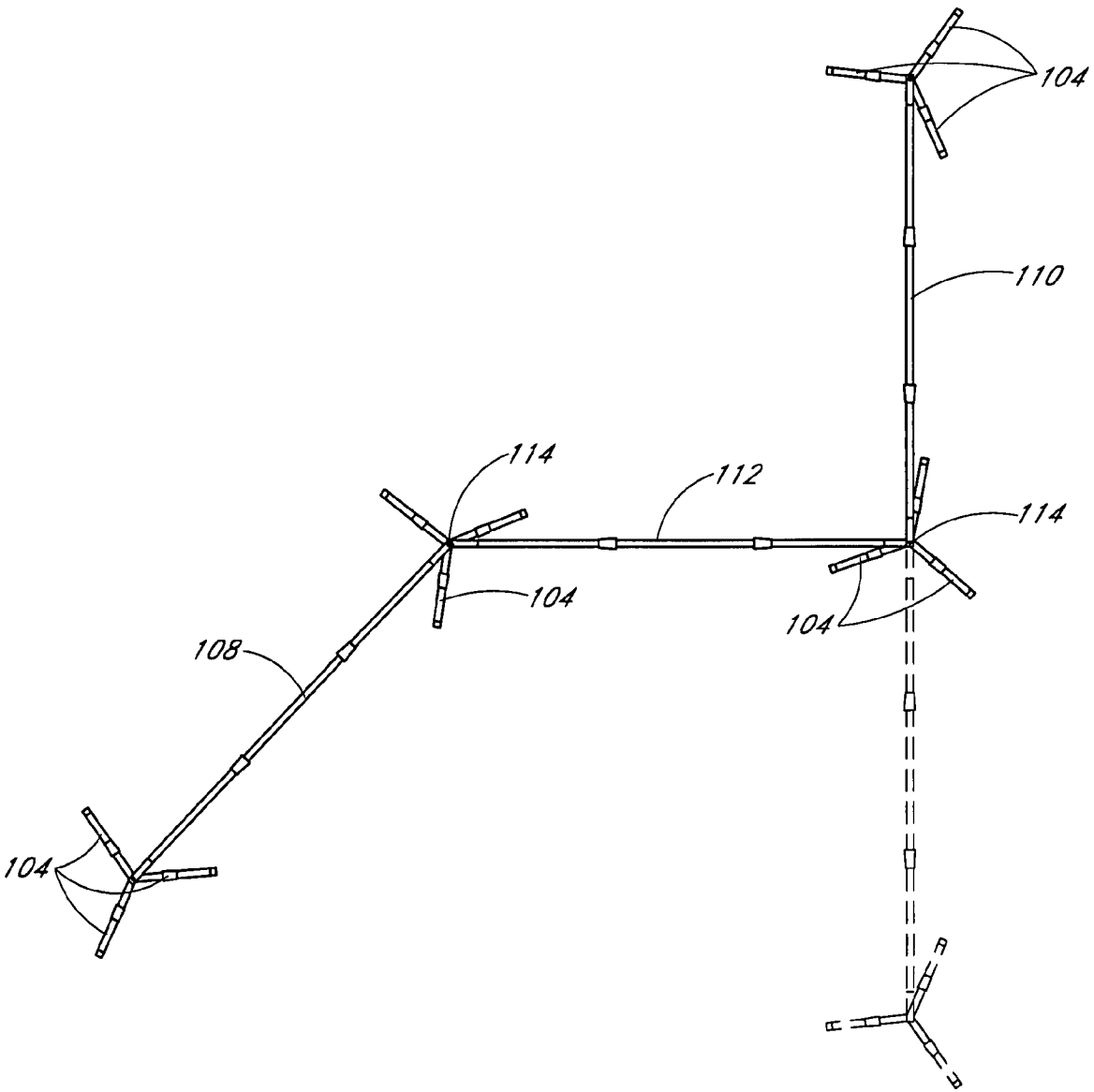
FIG. 5 is an overhead view of the barrier system of FIG. 1, illustrating the rotation of the panels and the adjustable legs.

An overhead view of the frame 102 is provided in FIG. 5. In particular, FIG. 5 shows that the illustrated frame 102 has rotation points 114 where the intermediate panel 112 is connected to the first and second end panels 108, 110. The rotation points 114 allow the panels to be rotated through an angle of nearly 360°, thereby providing great flexibility with respect to the large number of orientations in which the barrier system 100 can be deployed. As mentioned above, in other embodiments the frame 102 includes fewer than three panels or greater than three panels.

Additionally, FIG. 5 shows that the illustrated frame 102 is supported by a plurality of adjustable legs 104. In this exemplary embodiment, the adjustable legs 104 are disposed in groups of three having a tripod configuration, with a group of three legs 104 positioned at the ends of the panels 108, 110, 112. In other embodiments, the adjustable legs can be provided in groups of more than three legs, or less than three legs; however, use of three legs per group allows to frame to have good stability without being overly heavy. Generally, a barrier system 100 having n panels will have n+1 sets of three adjustable legs. Further details on the adjustable legs 104 will be provided below.

Figure 6:
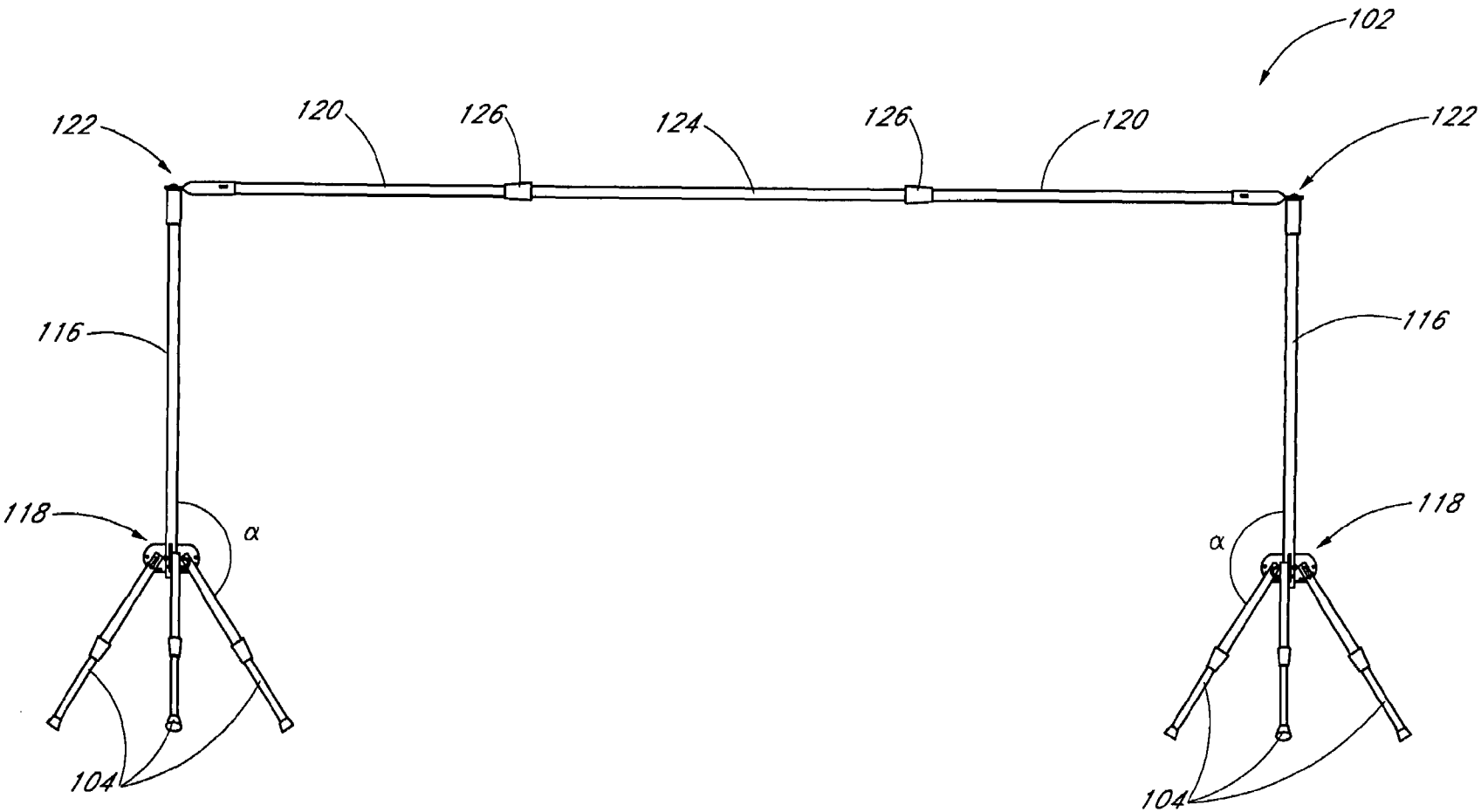
FIG. 6 is a side view of a single panel of an exemplary embodiment of the barrier system frame with an opaque curtain removed.

A side view of the frame 102 of one of the panels 108, 110, 112 is provided in FIG. 6. Generally, the end panels and the intermediate panel have a similar construction. In the illustrated exemplary embodiment, the frame 102 includes six adjustable legs 104 disposed in two groups of three, each group having a tripod configuration as described previously. The adjustable legs 104 are secured to a vertical tube 116 at a leg attachment assembly 118, which will be described in greater detail below. The vertical tubes 116 are each attached to a horizontal side tube 120 at a top elbow assembly 122, which is be described in greater detail below. Thus, in a single panel, there are two horizontal side tubes 120, as illustrated in FIG. 6. In such embodiments, the horizontal side tubes 120 are joined with an interconnecting horizontal intermediate tube 124, which is secured to the horizontal side tubes 120 using twist locks 126 in the illustrated embodiment. In this configuration, the horizontal side tubes 120 have an outer diameter configured to be received into the inner diameter of the horizontal intermediate tube 124, which results in a telescopable configuration.

Leg Attachment Assembly.

Figure 7:
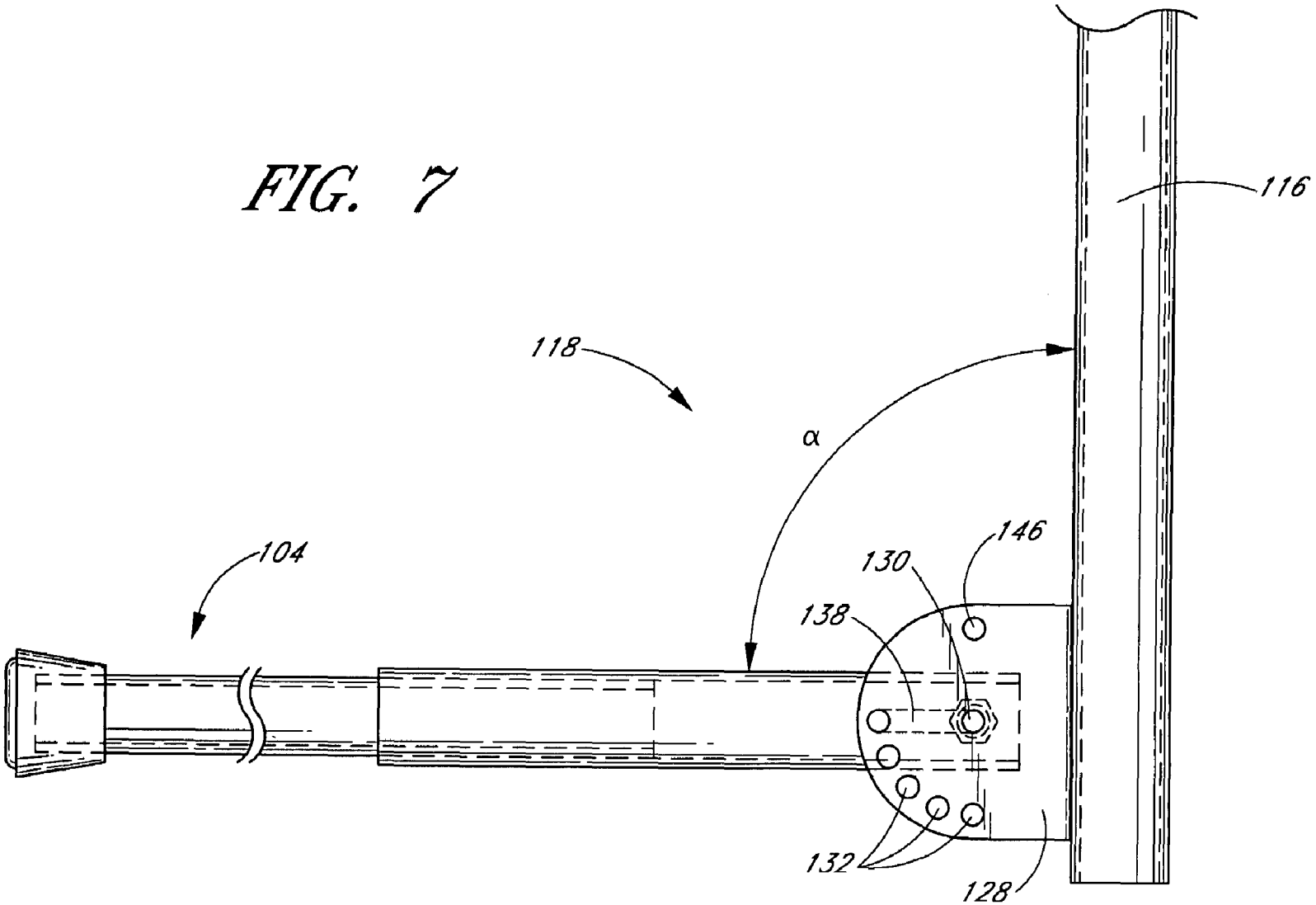
FIG. 7 is a side view of an exemplary embodiment of the leg attachment assembly.
Figure 8:
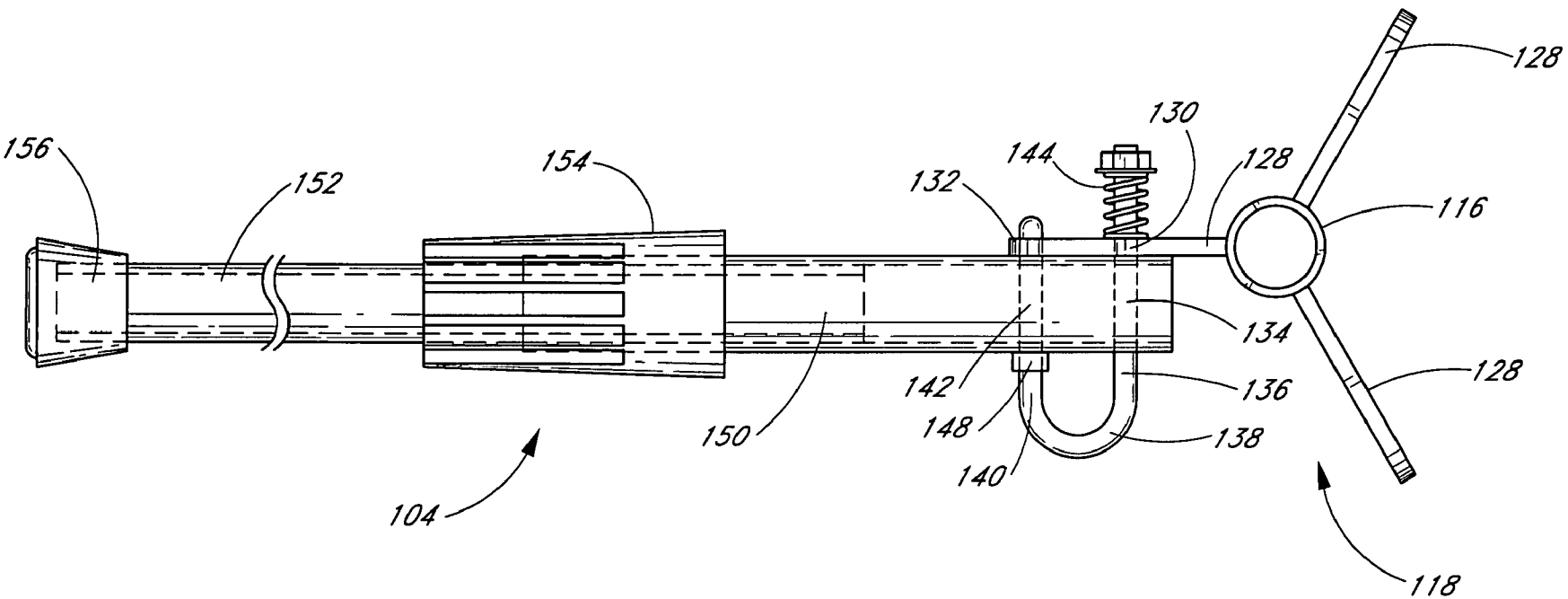
FIG. 8 is a top view of the leg attachment assembly of FIG. 7.

An exemplary embodiment of the leg attachment assembly 118, which allows the legs 104 to be adjustably attached to the vertical tubes 116, is illustrated in FIGS. 7 and 8. In particular, FIG. 7 is a side view of the leg attachment assembly 118, while FIG. 8 is a top view of the leg attachment assembly 118. Only one of the three legs 104 is shown in these figures for clarity. The illustrated leg attachment assembly 118 includes one or more semicircular leg mounting plates 128 that are attached, for example, by welding, to the vertical tube 116. Generally, a separate leg mounting plate 128 is attached to the vertical tube 116 for each leg 104 that is to be attached to the vertical tube 116. Thus, in the tripod leg configuration described above, three leg mounting plates 128 are attached to the vertical tube 116, as illustrated in FIG. 8. Only one of the leg mounting plates is illustrated in FIG. 7 for clarity.

Still referring to the exemplary embodiment illustrated in FIGS. 7 and 8, the leg mounting plate 128 includes a plate axle hole 130 and a plurality of plate circumferential holes 132. The plate axle hole 130 is configured to align with a leg axle hole 134 that passes through the upper portion of the leg 104 (see FIG. 8). When the plate axle hole 130 and the leg axle hole 134 are aligned, an axle prong 136 of a "U"-shaped pin 138 can be passed through both axle holes 130, 134. This arrangement allows the leg 104 to rotate around the plate axle hole 130, with the axle prong 136 acting as an axle. The leg 104 can be locked in a particular position by placing a locking prong 140 of the "U"-shaped pin 138 through a leg locking hole 142 in the leg 104, and into one of the circumferential holes 132 in the leg mounting plate 128.

In a modified embodiment, the "U"-shaped pin 138 can be secured in the locked position by placing a spring 144 on the axle prong 136, as illustrated in FIG. 8. A stop nut 148 is optionally positioned on the pin 138, thus preventing the curved portion of the pin 138 from being pulled into, and possibly wedged in, the leg locking hole 142. In such embodiments, the leg 104 can be unlocked by pulling the locking prong 140 out of the plate circumferential hole 132, thereby rendering the leg 104 free to rotate around the plate axle hole 130, as described above. Additionally, the leg 104 can be fully removed from the leg mounting plate 128 by removing the pin 138 from the leg mounting plate 128 altogether.

The leg attachment assembly 118 allows the leg 104 to be rotated with respect to the vertical tube 116 through a wide range of angles $\alpha$ that range from $\alpha$ 0° to $\alpha$ 180°. For example, in FIG. 7, the leg 104 is oriented substantially perpendicular to the vertical tube 116. Each of the plate circumferential holes 132 allows the leg 104 to be locked in a different position. In certain embodiments, a storage circumferential hole 146 is positioned such that the leg 104 can be "folded up" along and parallel to the vertical tube 116 (such that $\alpha$ 0°), thereby providing a compact storage configuration.

Certain features of an exemplary embodiment of the leg 104 are also illustrated in FIG. 8. In the illustrated embodiment, the leg 104 comprises a relatively small diameter tube 150 that is dimensioned to be received into a relatively large diameter tube 152. The tubes 150, 152 are interconnected with a twist lock 154. The small diameter tube 150 is generally able to slide in and out of the large diameter tube 152, but the twist lock 154 can be used to lock the position of the tubes 150, 152 such that they cannot be moved with respect to each other. This configuration advantageously allows the length of each of the legs 104 to be independently adjusted. The leg 104 also optionally includes an end cover 156 positioned over the end of the leg 104 configured to be placed on the ground. The end cover 156 is configured to provide additional friction between the ground and the leg 104, thereby increasing the overall stability of the barrier system 100. For example, in one embodiment the end over 156 comprises a rubber cap; other high-friction materials can be used in other embodiments.

Top Elbow Assembly.

As described previously, and as illustrated in FIG. 6, the frame 102 includes a top elbow assembly 122 that is used to secure the vertical tube 116 to one or more horizontal side tubes 124. Components of an example top elbow assembly 122 are shown in the exploded view of FIG. 9. As illustrated, the top elbow assembly 122 includes a hollow capping tube 158 that is open at a bottom end 160 and is tapped with a screw hole 180 at a top end 162. A detailed view of the hollow capping tube 158 is provided in FIGS. 10A and 10B. The body of the illustrated hollow capping tube 158 is also tapped with a screw hole and a nut 182 along the tube body. The nut 182 can be fastened to the tube body using any appropriate fastening technique, such as welding for instance. In an exemplary embodiment, the hollow capping tube 158 has an inner diameter dimensioned to receive the vertical tube 116 therein.

Figure 9:
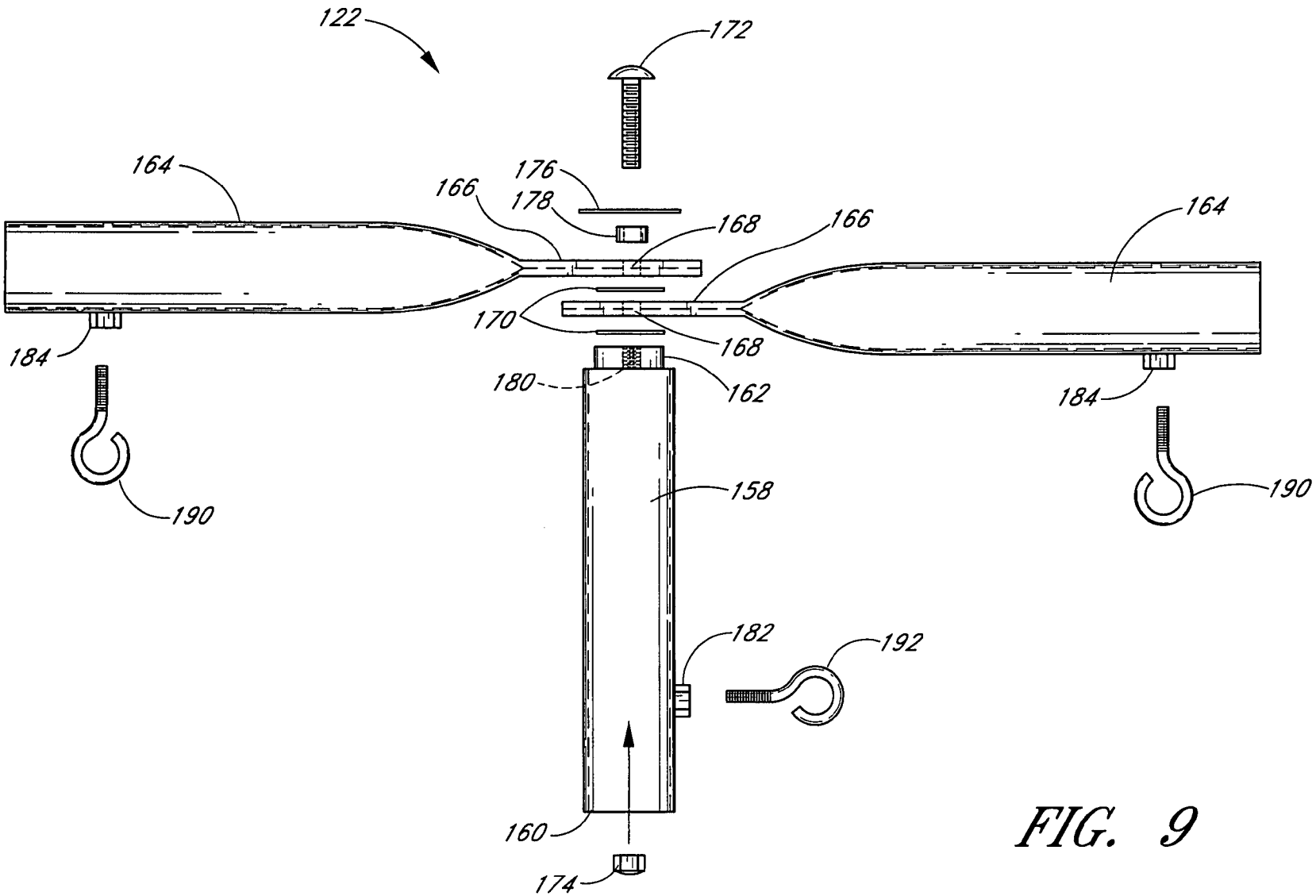
FIG. 9 is an exploded view of certain components of an exemplary top elbow assembly.
Figure 10A:
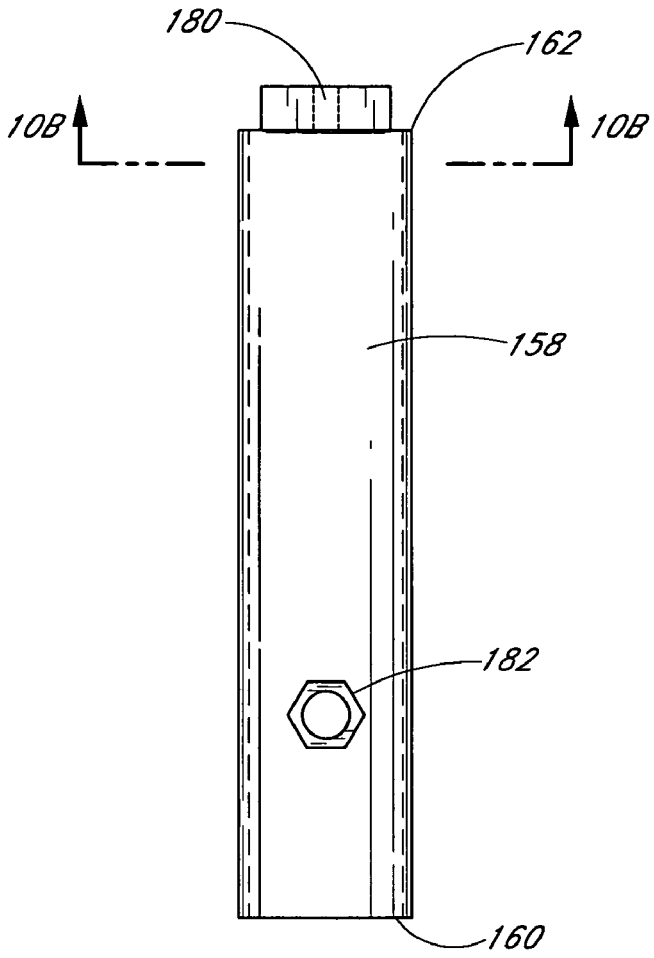
FIG. 10A is a side view of an exemplary embodiment of a capping tube that is included in the top elbow assembly of FIG. 9.
Figure 10B:
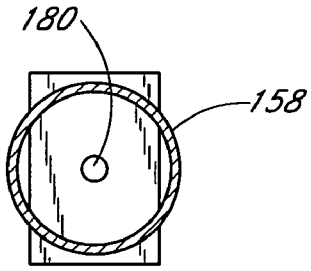
FIG. 10B is a top view of the capping tube of FIG. 10A, taken along line 10B–10B.
Figure 11A:
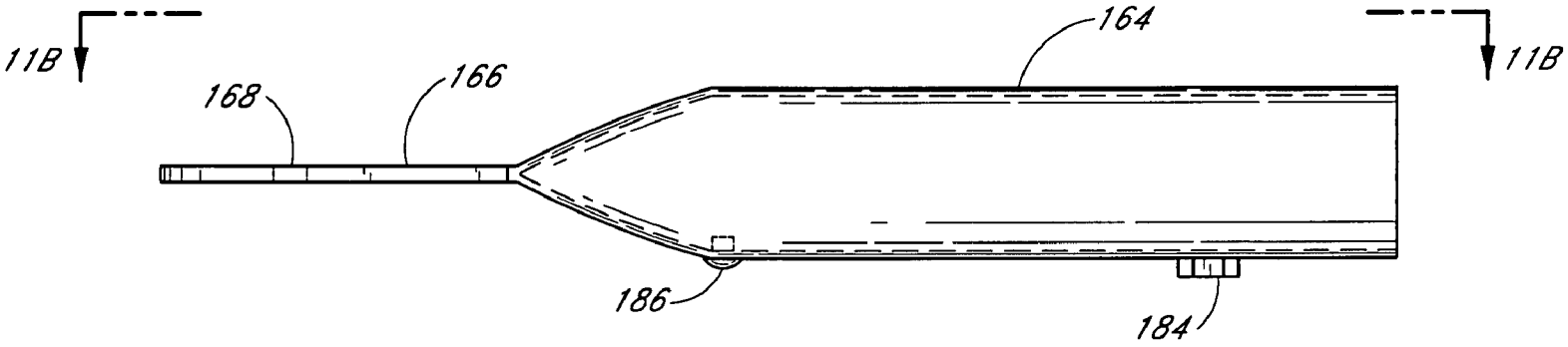
FIG. 11A is a side view of an exemplary embodiment of a side tube holder that is included in the top elbow assembly of FIG. 9.
Figure 11B:
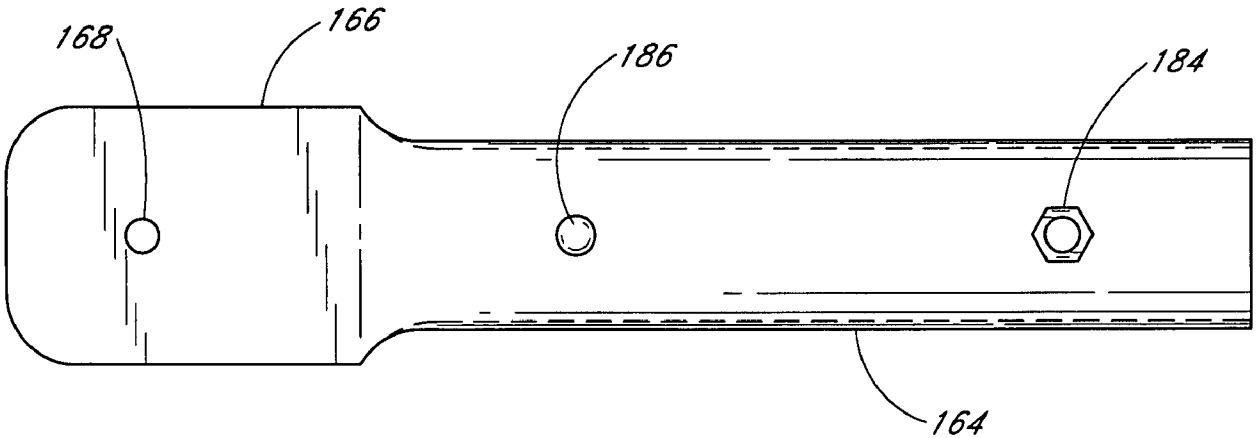
FIG. 11B is a top view of the side tube holder of FIG. 11A, taken along line 11B–111B.

One or more side tube holders 164, each having a flattened end 166 with a screw hole 168 can be positioned over the top end 162 of the hollow capping tube 158. For example, FIG. 9 illustrates two side tube holders 164 positioned over the hollow capping tube 158. A detailed view of an exemplary side tube holder 164 is provided in FIGS. 11A and 11B. As illustrated, the body of the side tube holder 164 is tapped with a screw hole and a nut 184 along the tube body. The nut 184 can be fastened to the tube body using any appropriate fastening technique, such as welding. A pop rivet 186 is optionally affixed to the side tube holder 164 as illustrated in FIGS. 11A and 11B. In an exemplary embodiment, the side tube holder 164 has an inner diameter dimensioned to receive one of the horizontal side tubes 120 therein.

Referring still to FIG. 9, washers 170, such as Teflon® washers, are optionally positioned between the capping tube 158 and the one or more side tube holders 164. The capping tube 158 and side tube holders 164 can be secured together using a screw 172 and a lock nut 174, as illustrated in FIG. 9. Optionally, a fender washer 176 and a bushing 178 can be included in the top elbow assembly 122, as illustrated.

Figure 12:
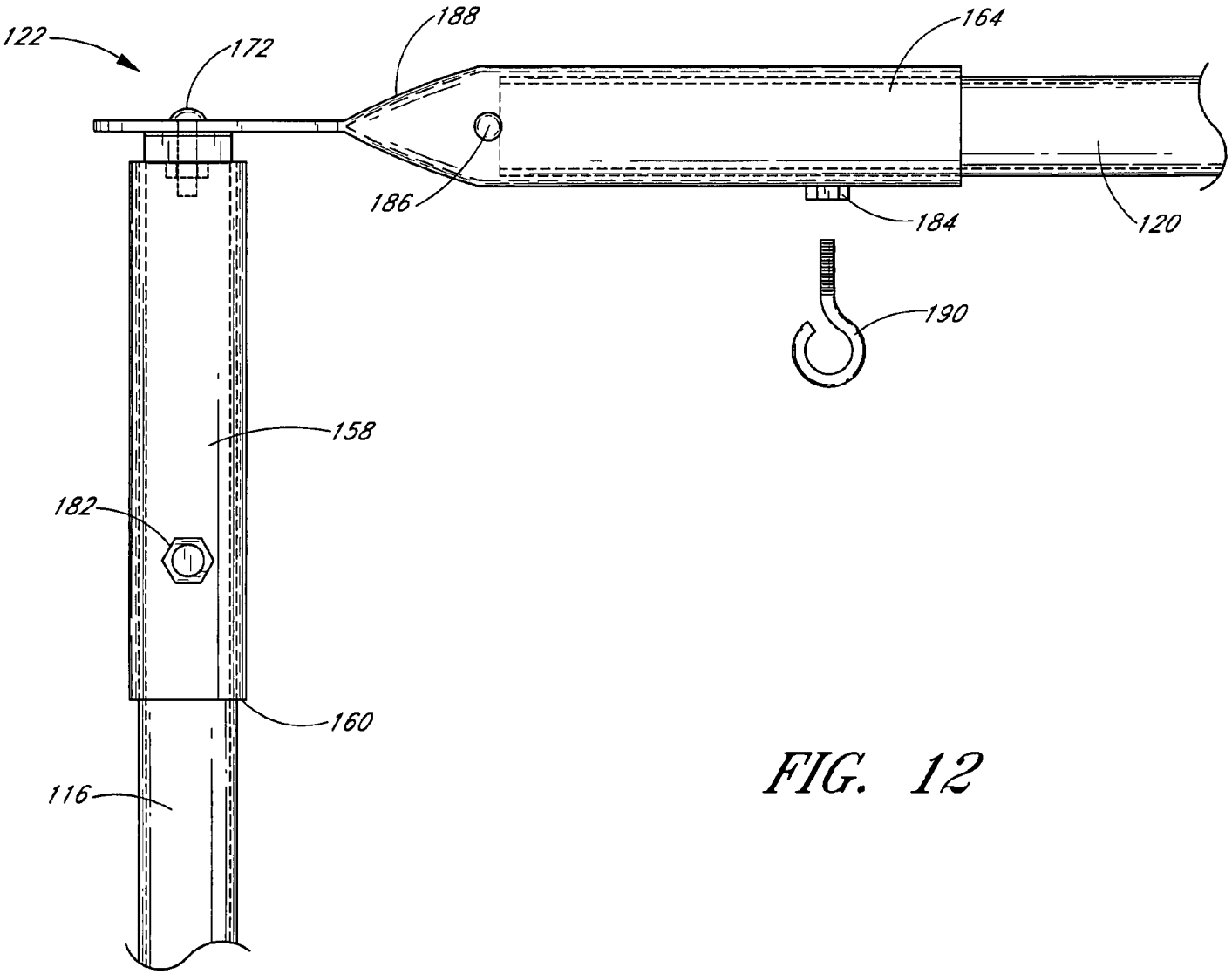
FIG. 12 is a side view of an exemplary top elbow assembly that has been mounted to a vertical tube and a horizontal tube.

An exemplary assembled top elbow assembly 122 having one side tube holder 164 is illustrated in FIG. 12. Additionally, FIG. 12 illustrates how the top elbow assembly 122 can be mounted to the vertical tube 116 and the horizontal side tube 120. In particular, the vertical tube 116 is slid into the bottom end 160 of the capping tube 158, and the horizontal side tube 120 is slid into the side tube holder 164. The presence of a pop rivet 186 reduces the likelihood that the horizontal side tube 120 can become wedged in the necked-down portion 188 of the side tube holder 164.

Figure 13:
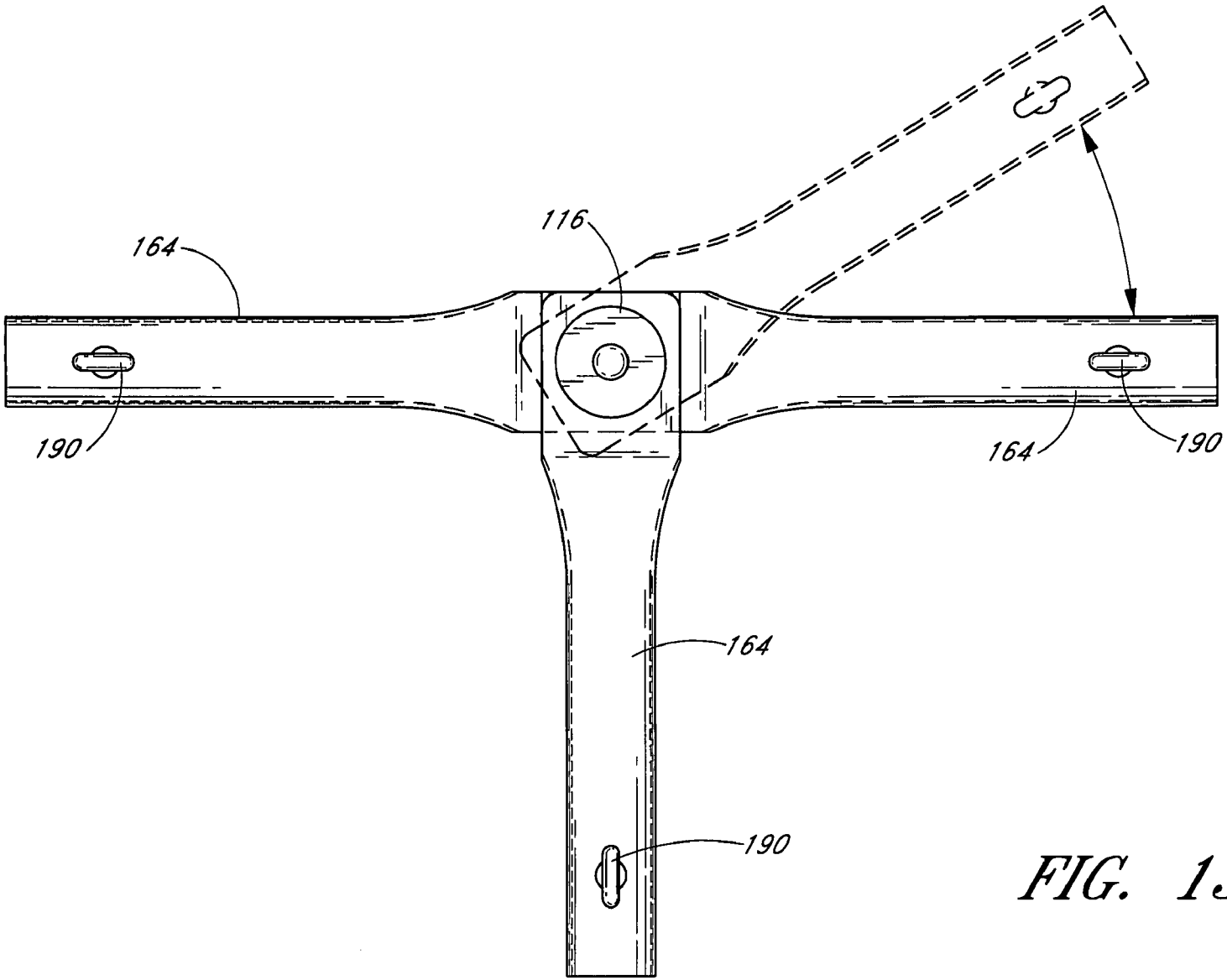
FIG. 13 is a top view of an exemplary top elbow assembly that includes three side tube holders.

The horizontal side tube 120 can be secured in the side tube holder 164 by threading an eyebolt 190 through a nut 184. Similarly, the vertical tube 116 can be secured in the capping tube 158 by treading an eyebolt 192 (see FIG. 9) through a nut 182. However, it should be clear that, before securing the vertical tube 116 and the capping tube 158 together, the horizontal side tube 120 can be rotated with respect to the vertical tube 116. In embodiments wherein the top elbow assembly 122 includes more than one side tube holder 164, the orientation of the side tube holders 164 can be adjusted by loosening the screw 172, and rotating the side tube holders 164 as desired. This concept is more clearly shown in FIG. 13, which is a top view of an exemplary top elbow assembly 122 having three side tube holders 164. As illustrated in FIG. 13, the side tube holders 164 are rotatable with respect to the vertical tube 116.

By configuring the side tube holders 164 to be rotatable with respect to the vertical tube 116, the barrier system can be deployed in the wide variety of configurations described above. In particular, referring again to FIG. 5, the vertical tubes 116 are positioned at the rotation points 114, with the panels 108, 110, 112 rotatable around the vertical tubes 116. The particular positioning of a panel can be easily adjusted by loosening the eyebolt 192, rotating the panel as desired, and then re-tightening the eyebolt 192. By including more than two side tube holders 164 in the top elbow assembly 122, such as illustrated in FIG. 13, still further barrier system configurations can be created.

Barrier System Assembly.

Having described the details of the leg attachment assemblies 118 and the top elbow assemblies 122, an exemplary technique for assembling an exemplary embodiment of the barrier system 100, such as illustrated in FIG. 1, will now be described in greater detail. The barrier system 100 described herein is configured such that it can be easily and quickly assembled from its individual components by a single person. When unassembled, an exemplary embodiment of the barrier system 100 is capable of being stowed in a relatively small area, such as in a small duffel bag or other storage container that can be easily placed in a car trunk.

Before assembling the barrier system 100, a deployment location is selected, and in particular, the desired locations of the leg attachment assemblies 118 are identified. As described above, a barrier system having three panels 108, 110, 112 will be supported by four leg attachment assemblies 118. Once these locations are identified, the leg attachment assemblies 118 are deployed. The legs 104 are adjusted—both in length and in deployment angle $\alpha$ as described above—such that the vertical tube 116 is substantially vertical. A bubble-type level or the like can be attached to or formed integrally with the vertical tube to help achieve more precise orientation.

Once the leg attachment assemblies 118 are deployed, the top elbow assemblies 122 are positioned atop each of the vertical tubes 116. In a barrier system having three panels, such as illustrated in FIG. 1, top elbow assemblies 122 having one side tube holder 164 are positioned on the two vertical tubes 116 at either end of the barrier system 100, while top elbow assemblies 122 having two side tube holders 164 are positioned on the two intermediate vertical tubes 116. It should be clear that in barrier systems having more complex shapes, top elbow assemblies 122 having an appropriate number of side tube holders 164 can be positioned on each vertical tube 116. In particular, the number of side tube holders 164 associated with a particular vertical tube 116 corresponds to the number of panels that adjoin the vertical tube 116. In addition, in some embodiments, the top elbow assemblies can be positioned prior to deployment of the vertical tubes.

After the appropriate top elbow assemblies 122 are positioned atop the vertical tubes 116, horizontal side tubes 120 are secured in each of the side tube holders 164. For each panel, a horizontal intermediate tube 124 is then positioned to connect the two horizontal side tubes 120. As illustrated in FIG. 6, the horizontal side tubes 120 and the intermediate tube 124 are connected using a twist lock 126 positioned adjacent to either end of the intermediate tube 124. Once the horizontal intermediate tubes 124 have been positioned, the eyebolts 190, 192 on the top elbow assemblies 122 can be tightened to secure the frame in place.

Figure 14:
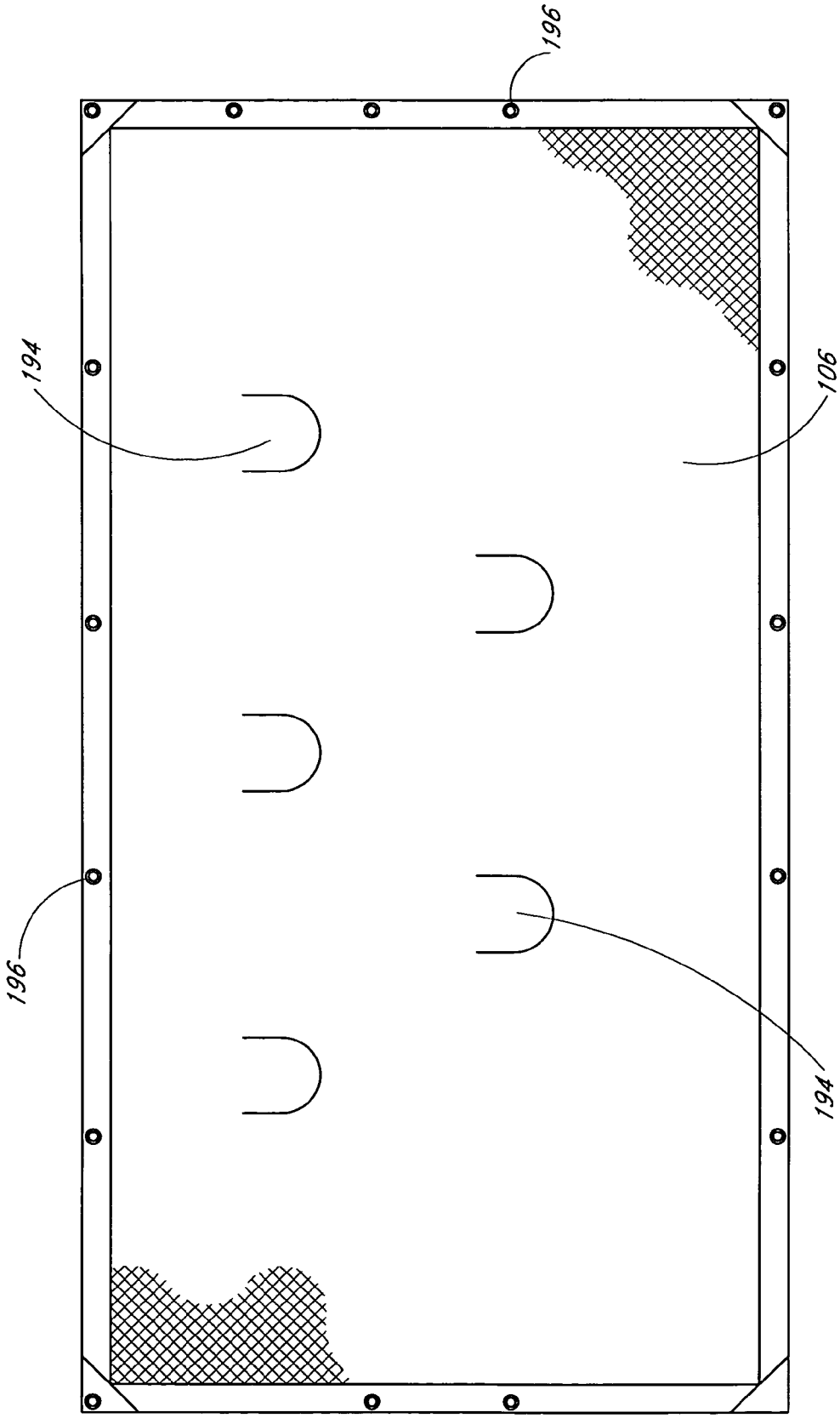
FIG. 14 is a side view of an exemplary embodiment of an opaque curtain that can be used with the barrier system disclosed herein.

Once the frame has been assembled, using the procedure set forth herein or an equivalent procedure, opaque curtains 106 are secured to one or more of the panels 108, 110, 112. An exemplary opaque curtain 106 is illustrated in FIG. 14. As illustrated, the opaque curtain 106 comprises a opaque panel dimensioned to fit within the panels 108, 110 112 of the frame 102, as described above. In an exemplary embodiment, the opaque curtain 106 comprises a canvas material, although other suitable materials—such as plastic or Mylar®—can be used in other embodiments. The opaque curtain 106 optionally includes one or more wind vents 194 to reduce the likelihood of the barrier system 100 toppling when subjected to strong winds or other inclement weather. Preferably, the degree of opacity is such that a clear view of the cordoned area is not possible. In some embodiments, however, more transparent curtains can be used.

Figure 15:
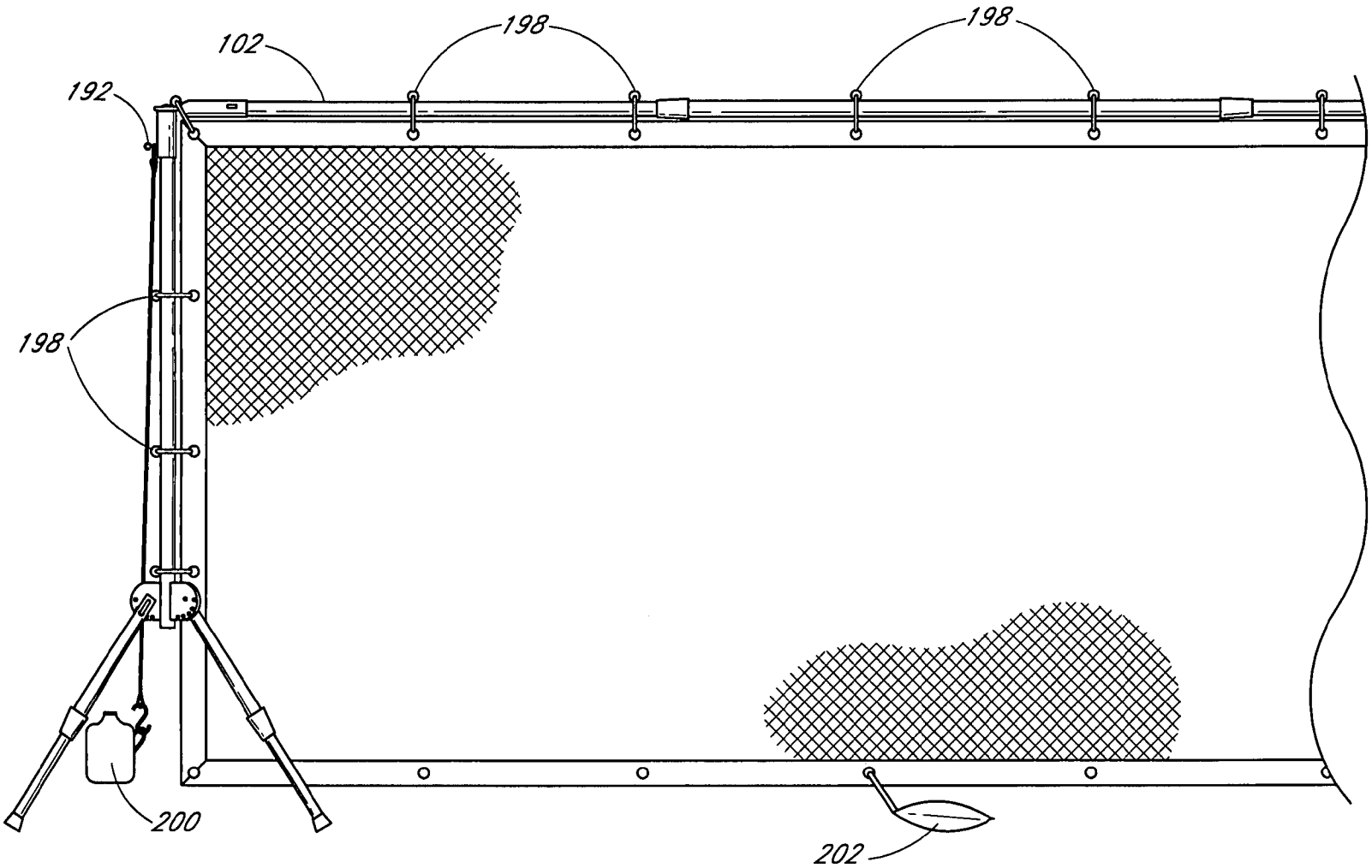
FIG. 15 is a side view illustrating an exemplary technique for securing the opaque curtain to the barrier system frame.

Still referring to the exemplary embodiment illustrated in FIG. 14, the opaque curtain 106 preferably also includes a plurality of grommets 196 positioned around the curtain perimeter, the grommets 196 optionally being approximately equally spaced apart. The grommets 196 can be used to secure the opaque curtain to the frame 102, as illustrated in FIG. 15. In particular, a plurality of elastic ball ties 198 can be used to secure the opaque curtain 106 to the frame 102 at the locations of the grommets 196. Elastic ball ties 198 are available from Hoover Fence Company (Newton Falls, Ohio).

The stability of the barrier system 100 described herein can be enhanced by attaching an optional anchor 200 to the frame 102, as illustrated in FIG. 15. For example, in one embodiment, the anchor 200 can be a heavy object, such as a jug of water, a sandbag, or a bag of rocks, hung from the frame 102. In one embodiment, the anchor 200 is hung from the eyebolt 192 of the top elbow assembly 122. In another embodiment, the anchor 200 can be hung from the top of the frame 102. It should be evident that the anchor 200 need not be a heavy object, but can also comprise a spike that can be secured in the ground.

For further stability, and as illustrated in FIG. 15, in a modified embodiment one or more sandbags 202 can be tied to one or more of the grommets 196 along the bottom perimeter of the opaque curtain 106. Securing sandbags 202 to the bottom perimeter of the opaque curtain 106 reduces flapping of the bottom of the curtain 106 when the barrier system is subjected to windy or otherwise inclement weather.

Figure 16:
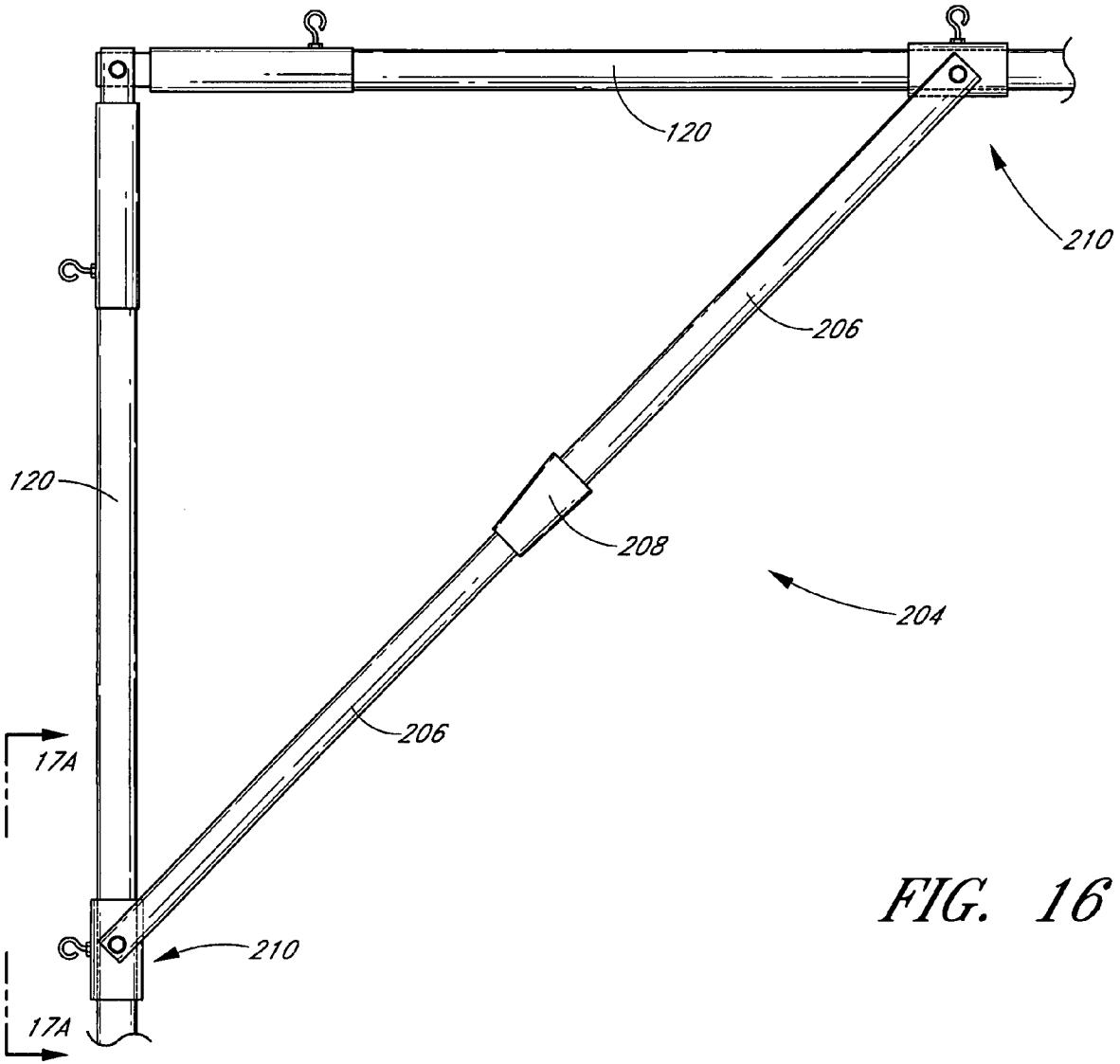
FIG. 16 is a top view of an exemplary embodiment of a wind brace that has been secured to the barrier system frame.

The stability of the barrier system 100 can also be enhanced by installing an optional wind brace 204 on the frame 102, as illustrated in FIG. 16. In such embodiments, the wind brace 204 comprises two support tubes 206 having different diameters that can be jointed with a twist lock 208. The two support tubes 206 are secured to horizontal side tubes 120 of two different panels of the barrier system 100, thereby enhancing the stability of the barrier system 100 in windy or otherwise inclement weather.

Figure 17A:
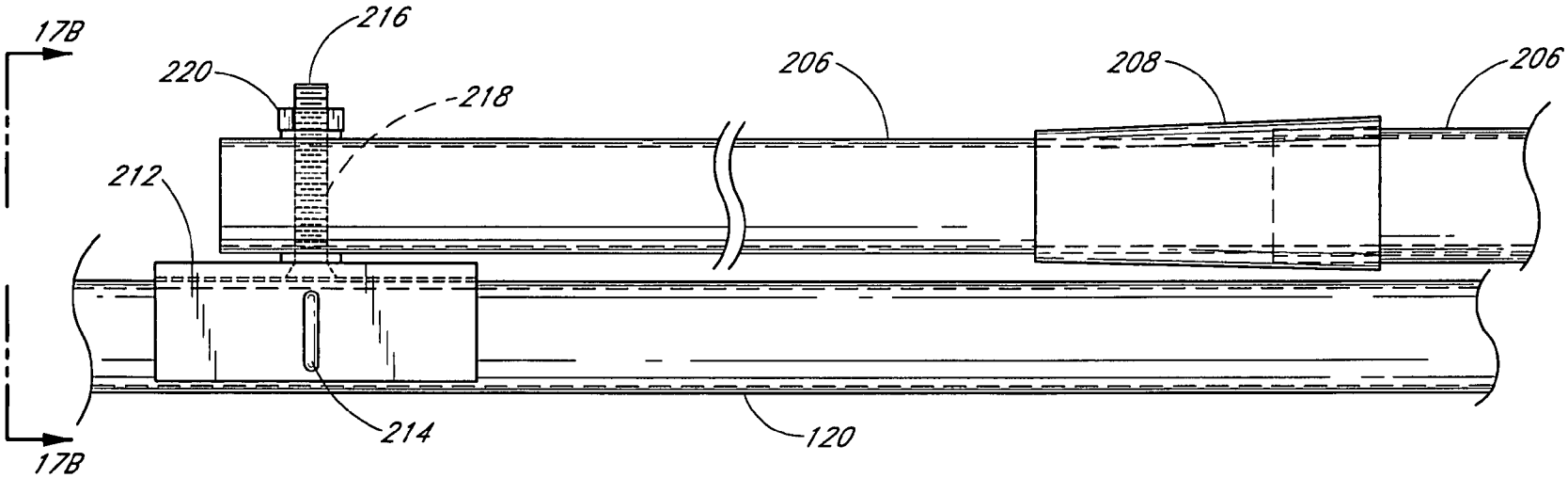
FIG. 17A is a side view of an exemplary embodiment of a movable clamp used to secure a wind brace to the barrier system frame, taken along line 17A–17A of FIG. 16.
Figure 17C:
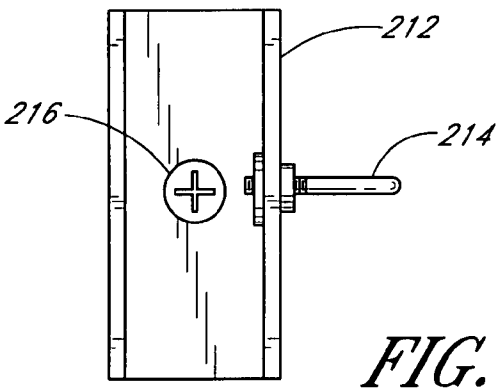
FIG. 17C is a bottom view of the movable clamp of FIG. 17B, with the horizontal side tube removed for clarity, taken along line 17C–17C.
Figure 17B:
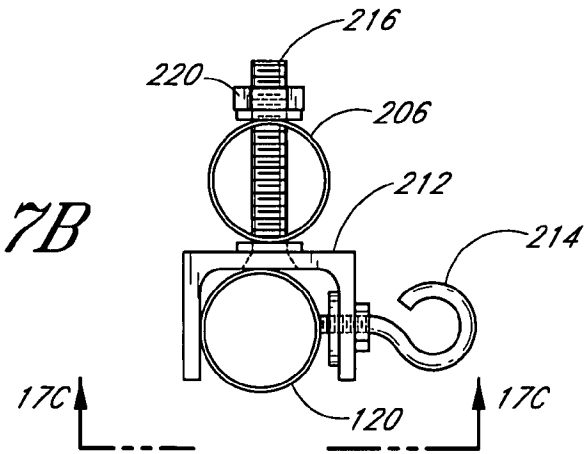
FIG. 17B is a end view of the movable clamp of FIG. 17A, taken along line 17B–17B.

The support tubes 206 are secured to the horizontal side tubes 120 using movable clamps 210, which are illustrated in greater detail in FIGS. 17A, 17B and 17C. In particular, the movable clamp 210 comprises a brace 212 configured to be positioned over one of the horizontal side tubes 120. In particular, the brace 212 can be secured to one of the horizontal side tubes 120 by tightening an eyebolt 214, as illustrated in FIG. 17B. Once the brace 212 is secured to the horizontal side tube 120, the wind brace support tube 206 can be secured to the external side of the brace 212 as illustrated in FIGS. 17A and 17B. In particular, the wind brace support tube 206, which includes a screw hole 218, can be passed over a flathead screw 216 protruding from the external side of the brace 212. The support tube 206 can then be secured to the brace 212 by tightening a lock nut 220 onto the flathead screw 216.

The wind brace 204 provides additional stability to the barrier system 100, which is particularly advantageous in windy or otherwise inclement weather. Specifically, installation of the wind brace 204 restricts movement of the panels to which it is attached. As described above, the positioning of the braces 212 along the horizontal side tubes 120 is adjustable, thereby allowing the wind brace 204 to be installed in a wide variety of different barrier configurations.

Roof Assembly.

Figure 18:
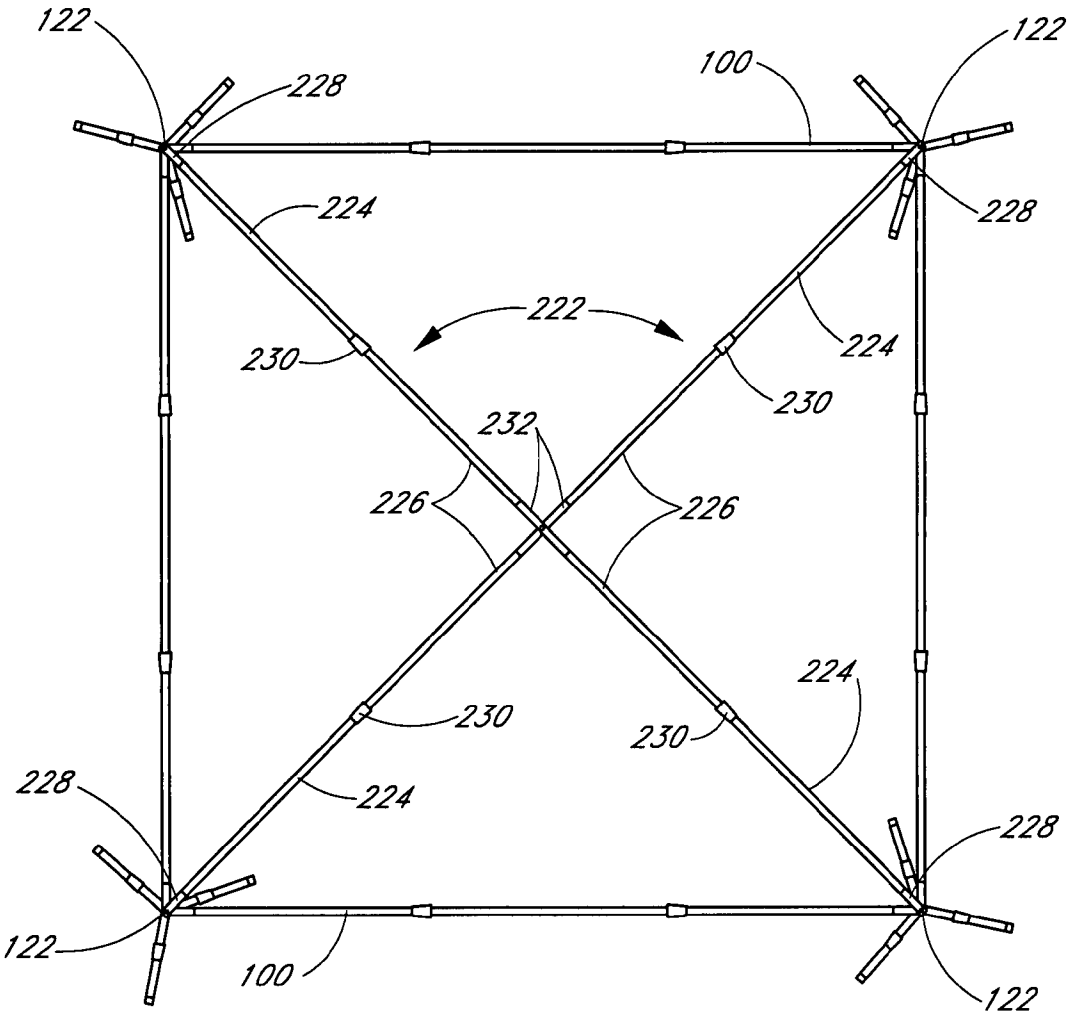
FIG. 18 is a top view of an exemplary roof frame configured for use with the portable barrier system disclosed herein.

In certain embodiments, a plurality of barrier system panels can be arranged such that an enclosed area is created, such as an enclosed, three- or four-sided room. In such embodiments, it can be advantageous to have the enclosed area covered with a roof to provide protection from environmental conditions such as snow, rain, or intense sunlight. FIG. 18 illustrates that an optional roof support frame can be used to support a roof over an area that has been enclosed using the barrier system 100 described herein.

Figure 19:
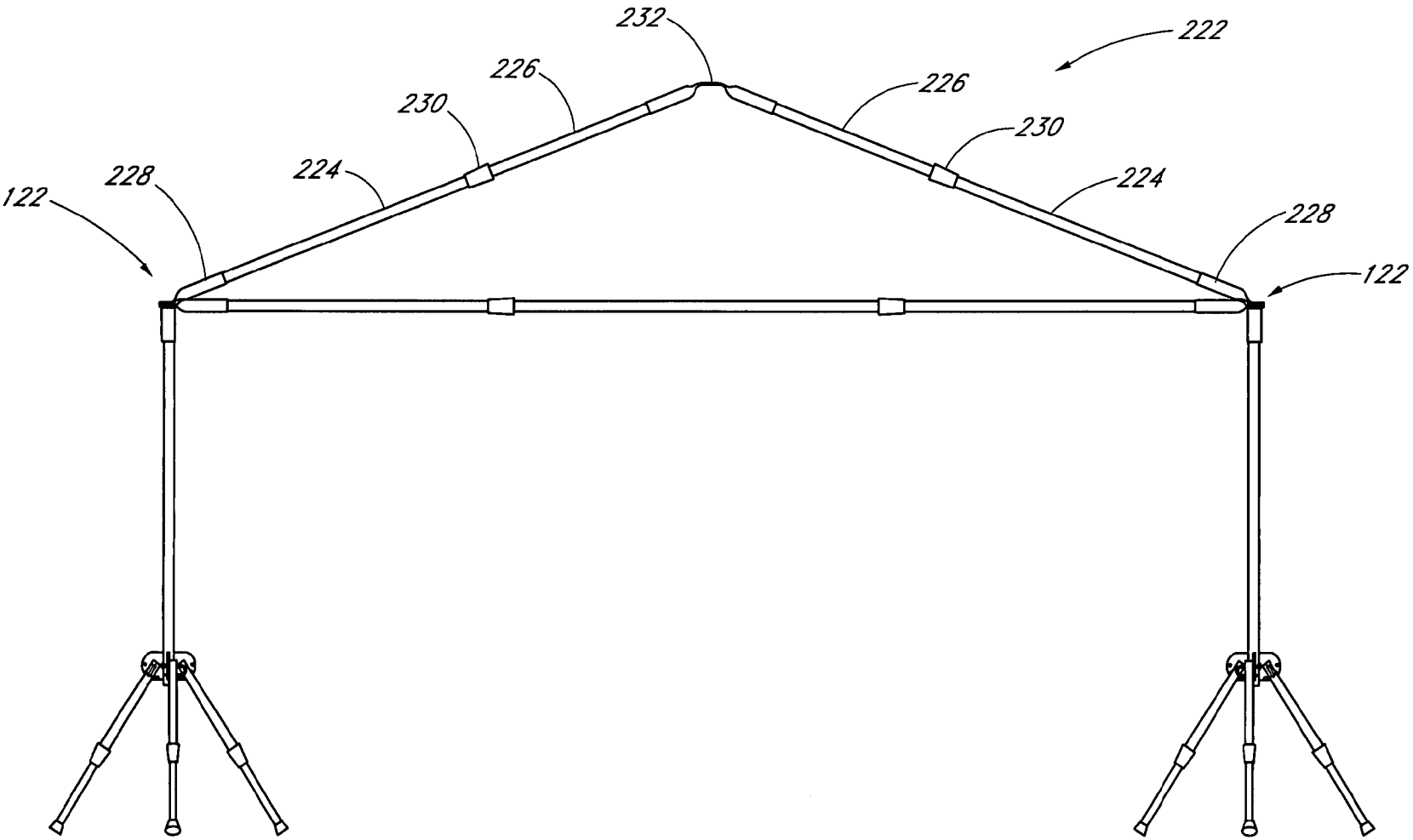
FIG. 19 is a side view of the exemplary roof frame of FIG. 18.

In particular, FIG. 18 illustrates that two orthogonal roof support members 222 can be used to support a roof over an enclosed area formed by the barrier system 100 described herein. Each of the illustrated roof support members 222 comprises two lower roof support bars 224 and two upper roof support bars 226, The lower roof support bars 224 can be mounted to the top elbow assemblies 122 using an inclined roof support holder 228, as illustrated in FIG. 19. In such embodiments, the inclined roof support holder 228 is mounted to the top elbow assemblies 122 in the same manner that the side tube holders 164 are mounted to the top elbow assemblies 122 (see FIG. 9). In an exemplary embodiment, the lower roof support bars 224 are secured to the upper roof support bars 226 using twist locks 230, although other removable fasteners can be used in other embodiments.

In the illustrated exemplary embodiment, for each of the roof support members 222, the two upper roof support bars 226 are connected with a roof center support 232 that is positioned at the apex of the roof. A detailed view of an exemplary roof center support 232 is provided in FIGS. 20A and 20B. As illustrated, the roof center support 232 includes two hollow tube portions 234 configured to receive the upper roof support bars 226. The hollow tube portions 234 include one or more through holes 236 configured to align with one or more through holes (not shown) on the upper roof support bars 226. When the upper roof support bars 226 are inserted into the hollow tube portions 234 such that the through holes in these two elements align, a locking pin 238 can be inserted through the aligned holes, thereby securing the upper roof support bars 226 to the roof center support 232. Other locking mechanisms also can be used.

Figure 20A:
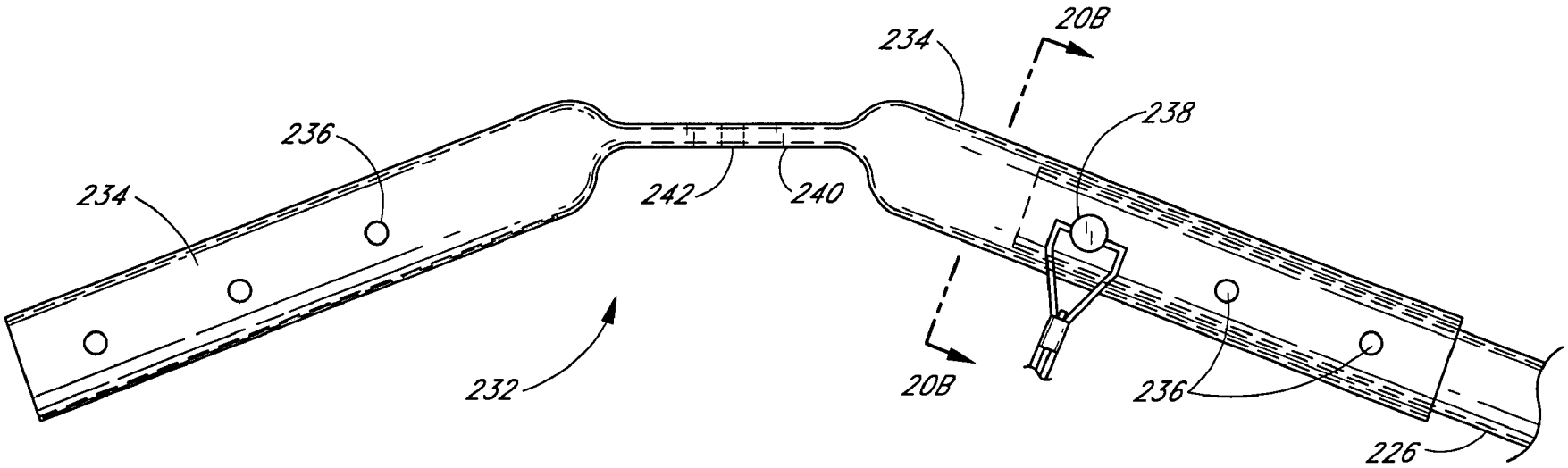
FIG. 20A is a side view of an exemplary embodiment of a roof center support configured to interconnect two upper roof support bars.
Figure 20B:
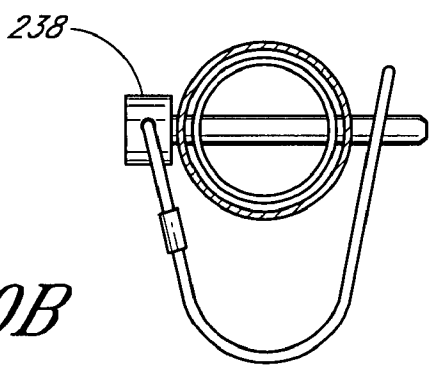
FIG. 20B is a cross-sectional view of the roof center support of FIG. 20A, taken along line 20B–20B.
Figure 21:
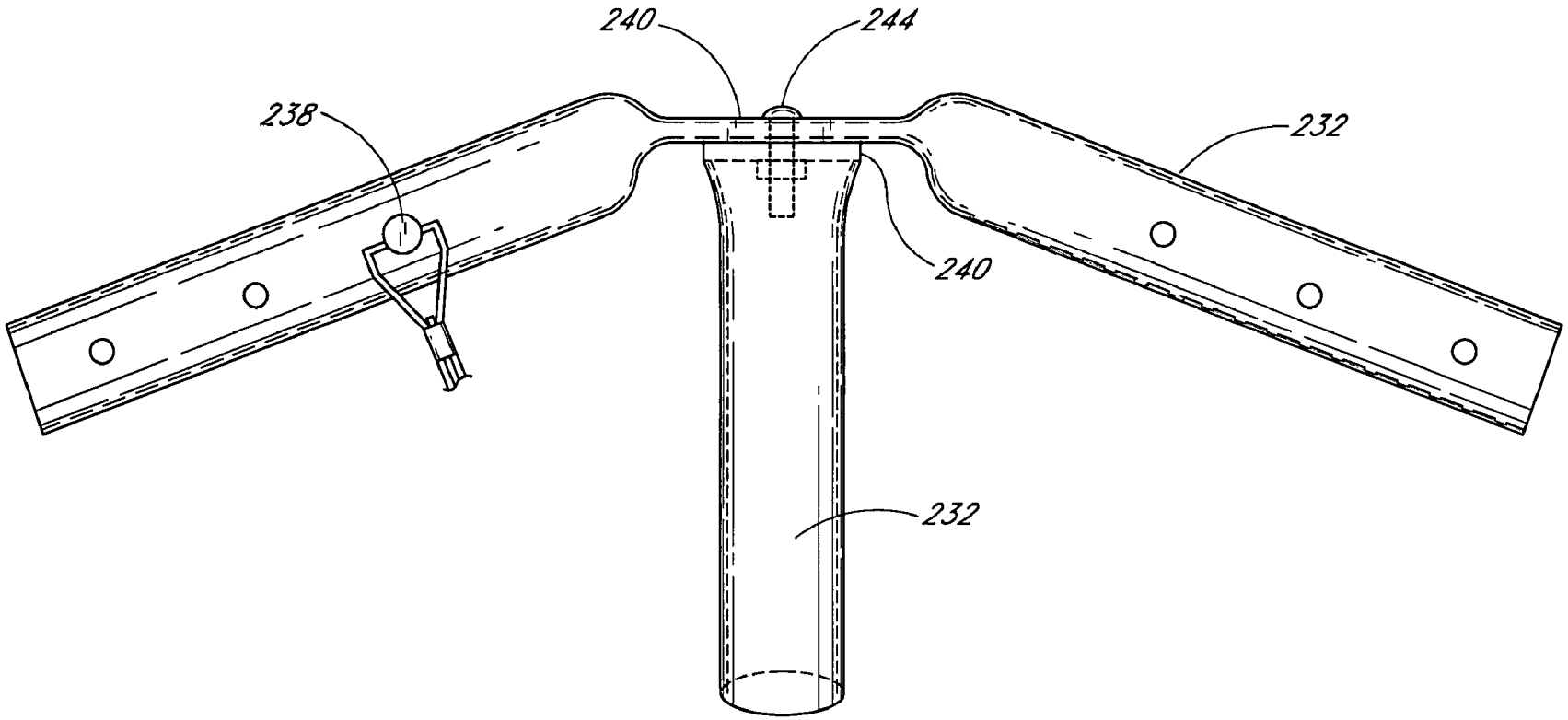
FIG. 21 is a side view of two exemplary roof center supports secured together with a screw.

Referring still to FIG. 20A, the roof center support 232 optionally includes a center flattened portion 240 that has a screw hole 242. As illustrated in FIG. 21, this configuration allows roof center supports 232 corresponding to each of the two orthogonal roof support members 222 to be secured together with a screw 244 at the roof apex. Although securing the two orthogonal roof support members 222 at the roof apex is optional, doing so advantageously provides the roof with enhanced structural stability, with is particularly useful when the roof is subjected to windy or otherwise inclement weather conditions.

Figure 22:
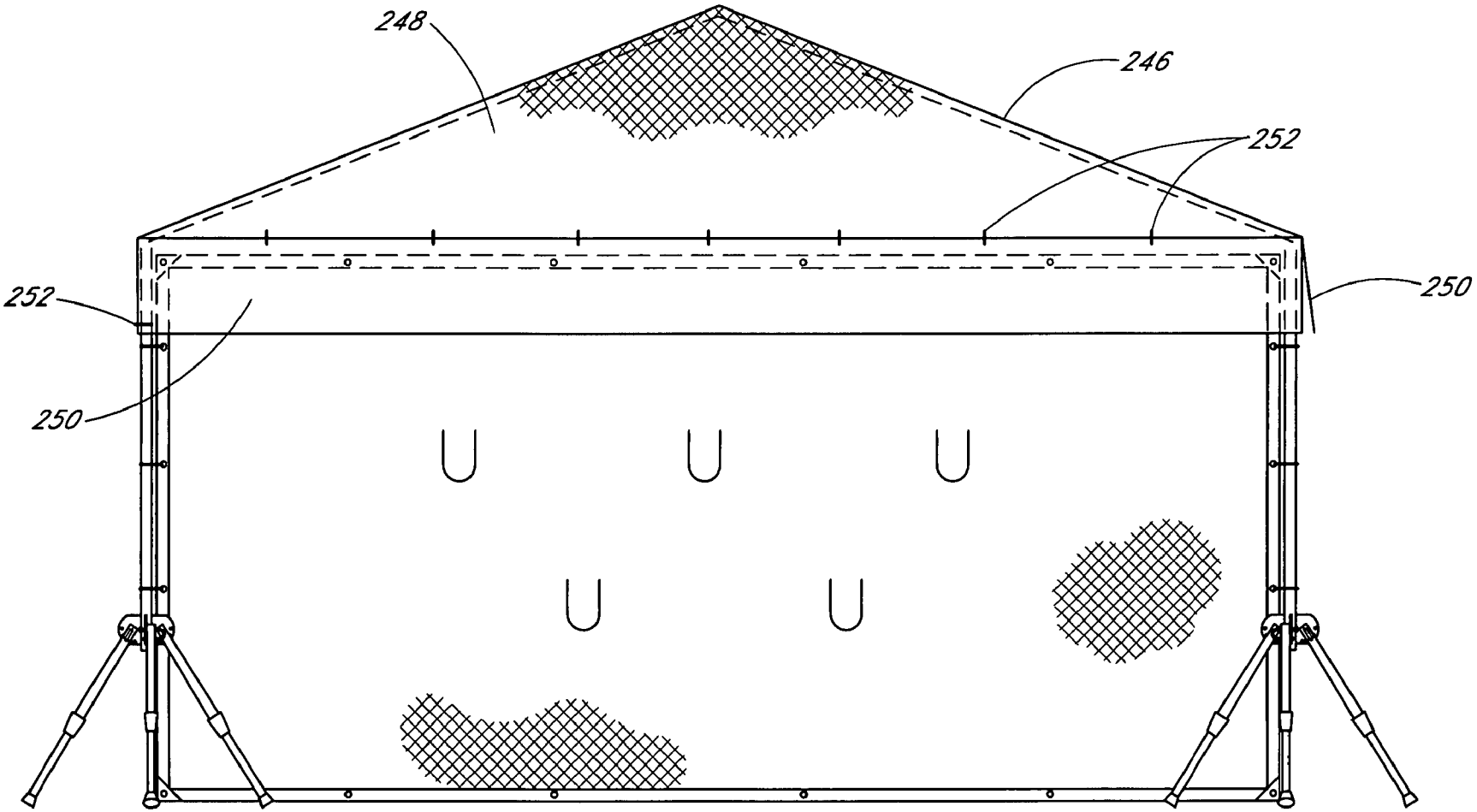
FIG. 22 is a side view of an exemplary embodiment of a barrier system that encloses a covered area with a roof.

As referred to above, and as illustrated in FIG. 22, the optional roof support frame disclosed herein can be used to support a flexible roof 246 over an area that has been enclosed using the barrier system 100. The flexible roof 246 optionally includes internal grommets (not shown), such that elastic ball ties 252 can be used to secure the roof 246 to the underlying framing members. However, in a modified embodiment, the roof 246 is configured to securely fit over the roof support frame and a portion of the side panels of the enclosed area, such that additional securing mechanisms are not necessary.

An exemplary embodiment of the roof 246 includes a top portion 248 and overhanging eaves 250, the combination of which is configured to environmentally isolate the enclosed area from effects such as wind and moisture. Thus, the roof 246 comprises a material that is impermeable to water in such embodiments, such as a plastic tarp. The overhanging eaves 250 from each side of the enclosed area are optionally secured together, for example using elastic ball ties, so as to reduce the likelihood that the overhanging eaves 250 will flap against the side walls or the roof in windy or otherwise inclement weather.

Figure 23:
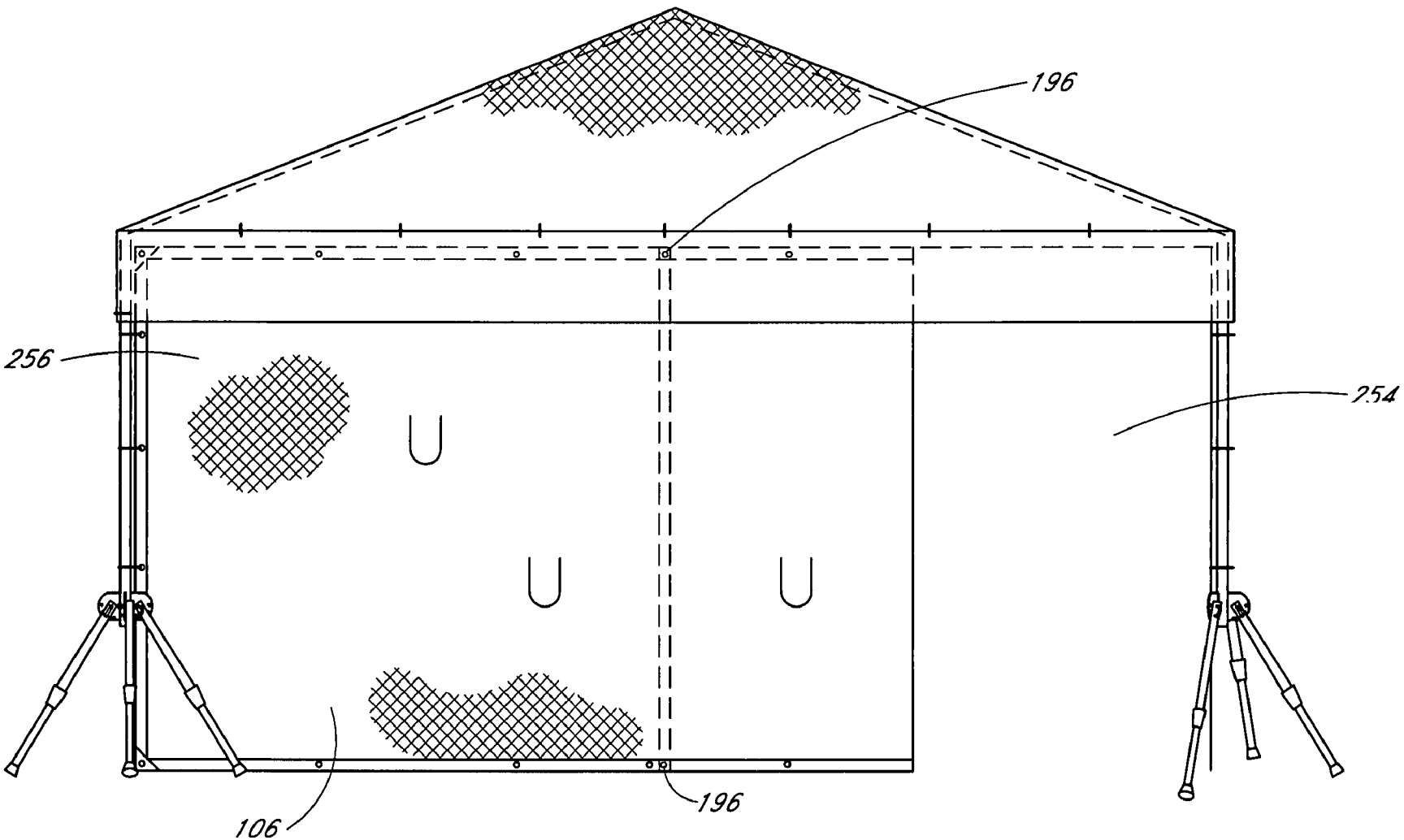
FIG. 23 is a side view of an exemplary embodiment of an enclosed room having an opening.

It should be recognized that a four-sided enclosure, or room, can be constructed using the barrier system disclosed herein. Additionally, the room can optionally include a roof using the roof assembly disclosed herein. One such configuration is illustrated in FIG. 23. In particular, FIG. 23 illustrates that an enclosed room can be provided with an opening 254, such as an entrance or exit, by folding back the opaque curtain 106 that forms the room sidewalls 256. The opening 254 can be maintained in an open condition by tying two grommets 196 together as illustrated, such as with an elastic ball tie. Likewise, the opening 254 can be closed by tying the opaque curtain grommets 196 to one of the vertical tubes 116. In embodiments of the barrier system wherein an enclosed room is created, the optional wind vents 194 can be omitted from the opaque curtain 106, thereby providing enhanced privacy within the room.

Figure 24:
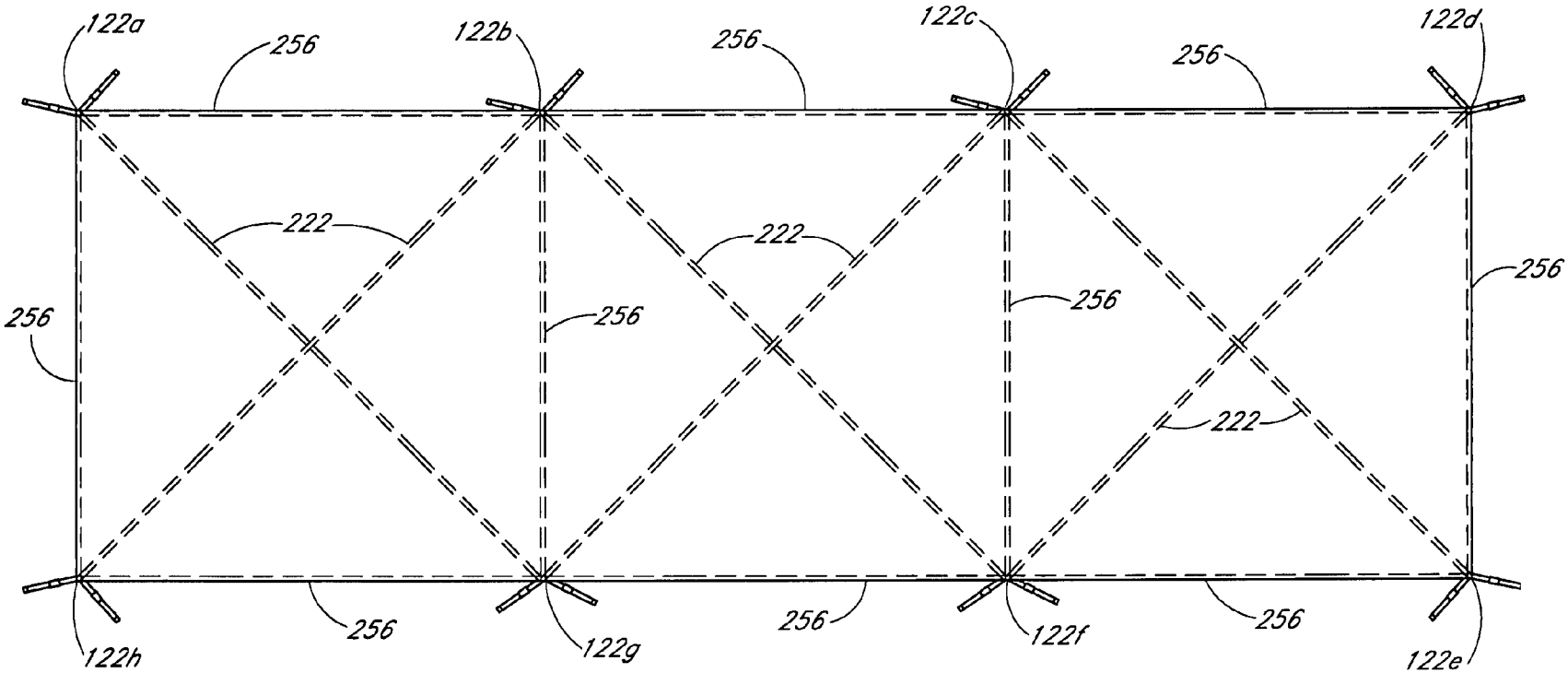
FIG. 24 is an exemplary embodiment of a multiple room structure that can be constructed using the barrier system.

Although FIG. 23 illustrates a single room, the barrier system 100 described herein can also be used to create structures comprising multiple rooms. For example, FIG. 24 illustrates an overhead view of the framing that can be used to create one embodiment of a multiple room structure. In particular, by configuring the top elbow assemblies 122 to include an appropriate number of side tube holders 164 (for adjacent room sidewalls 256) and inclined roof support holders 228, the appropriate room configuration can be constructed. For example, in the exemplary embodiment illustrated in FIG. 24, the top elbow assemblies 122*a*, 122*d*, 122*e* and 122*h* each include two side tube holders 164 for the two room sidewalls 256 that adjoin those top elbow assemblies, and one inclined roof support holder 228 for the one roof support member 222 that is supported by those top elbow assemblies. Similarly, the top elbow assemblies 122*b*, 122*c*, 122*f* and 122*g* each include three side tube holders 164 for the three room sidewalls 256 that adjoin those top elbow assemblies, and two inclined roof support holders 228 for the two roof support members 222 that are supported by those top elbow assemblies. Other multiple room configurations can be constructed in other embodiments using equivalent techniques.

Figure 25A:
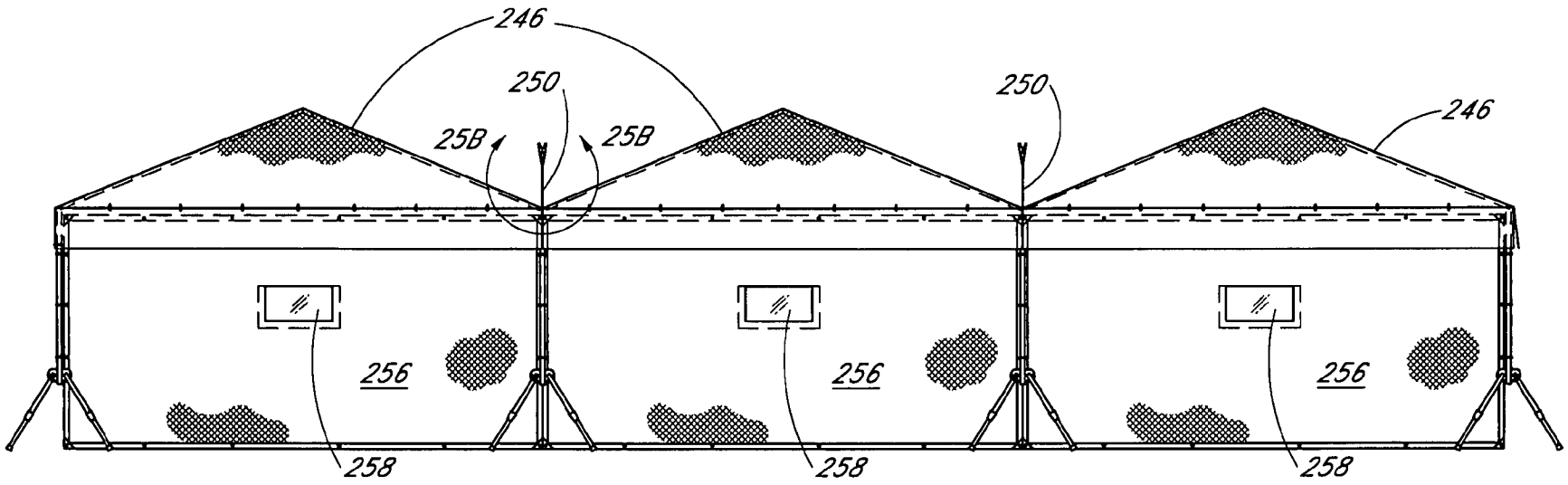
FIG. 25A is an elevation view of the multiple room structure of FIG. 24.
Figure 25B:
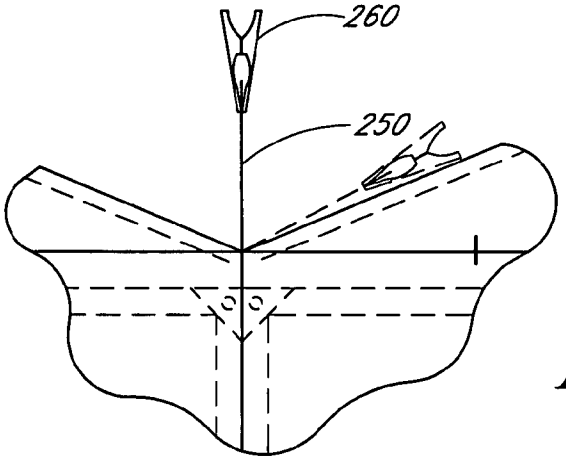
FIG. 25B is a detail view of an exemplary roof joint present in the multiple room structure of FIG. 25A.

The exterior of the exemplary structure illustrated in FIG. 24 is provided in the elevation view of FIG. 25A. Additionally, FIG. 25A illustrates that the room sidewalls 256 optionally include a window 258, which can serve a variety of purposes, such-as to increase the amount of light within the room, or to provide occupants of the room with an exterior view. In an exemplary embodiment, the window 258 comprises a transparent, flexible material, such as flexible Plexiglas®. The overhanging eaves 250 of adjacent rooms are optionally sealed together, such as with a clip 260, such as illustrated in the detail view of FIG. 25B. This configuration advantageously reduces the likelihood of water entering the enclosed area during inclement weather by passing down between adjacent roots 246.

Exemplary Materials and Dimensions.

As described above, the barrier system 100 disclosed herein can be configured for use in a wide variety of applications, such as to provide privacy for a cordoned off area, or to provide shelter from adverse environmental conditions such as wind and/or rain. Additionally, the barrier system 100 is portable, meaning that it can easily be collapsed into individual components, such as individual frame components, that can be stored in a relatively small space, such as the trunk of a car. Thus, specific materials and dimensions for the barrier system 100 can selected accordingly.

For example, in one exemplary embodiment, the structural members of the frame 102, such as the legs 104, the vertical tubes 116, the horizontal tubes 120, 124, and the roof support members 222, comprise powder-coated aluminum. The frame connection elements, such as the leg attachment assemblies 118 and the top elbow assemblies 122 can also comprise aluminum. Aluminum advantageously provides a structural frame that is relatively strong, but that is nevertheless light enough such that one person can carry the barrier system components in a storage bag. However, the structural members of the frame can comprise other materials or combinations of materials in other embodiments, such as steel, a resin-based material or a carbon graphite material, for example but without limitation.

As described above, in an exemplary embodiment, the opaque curtains 106 and the roof 246 comprise a material that provides sufficient protection from environmental conditions such as wind and precipitation. Examples of such materials include, but are not limited to, nylon, polyester and polypropylene. Composite or multi-layered materials can be used in other embodiments. The opaque curtains 106 and/or the roof 246 optionally include a transparent window, such as a flexible Plexiglas® window, to provide additional light to an enclosed area, or to provide occupants of an enclosed area with a outside view.

The barrier system 100 disclosed herein can be configured to have a wide variety of dimensions, depending on a particular application. In one embodiment, the barrier system is provided with dimensions that allow the individual components to be disassembled and placed in a storage bag that is small enough to fit within the trunk of a standard passenger car. This configuration advantageously enhances the portability of the barrier system 100, since special storage or handling equipment is unnecessary.

For example, in one embodiment, the panels 108, 110, 112 have a length of approximately 12 feet, such that a three-paneled barrier system (as illustrated in FIGS. 1 through 5) has a total length of approximately 36 feet. In such embodiments, the vertical tubes 116 are configured to have a height of approximately 6 feet, although the exact height can be adjusted by manipulating the length of the adjustable legs 104, as described above. For example, the leg tubes 150, 152 (see FIG. 8) can each have a length of approximately two feet, such that the overall height of the leg 104 can be adjusted from approximately 2 feet to approximately four fee using the leg twist lock 154. The height of the legs 104 can be adjusted to provide a more secure foundation on uneven terrain, and can also be adjusted to manipulate the overall height of the barrier system 100. In embodiments using the panel dimensions described herein, an opaque panel 106 having dimensions of approximately 6 feet high by approximately 12 feet long can be mounted on the frame 102.

The structural members of the frame 102, such as the legs 104, the vertical tubes 116, the horizontal tubes 120, 124, and the roof support members 222, comprise hollow cylindrical tubes having an outer diameter ranging from approximately 0.75 inches to approximately 1.25 inches. In instances where two structural members are joined with a twist lock component, such as described herein, the two structural members can be provided with slightly different outer diameters. For example, in one embodiment, a first structural member has an outer diameter of approximately 1.000 inches, and a second structural member has an outer diameter of approximately 1.125 inches. Examples of structural members that are joined in this fashion include, but are not limited to, the leg tubes 150, 152 (see FIG. 8), the horizontal tubes 120, 124 (see FIG. 6), the tubes comprising the roof support members 222 (see FIG. 18), and the tubes comprising the wind brace 204 (see FIG. 16). The wall thickness of the tubes used herein is selected to provide the structural members with sufficient structural integrity, and in an exemplary embodiment, is between approximately 0.04 inches and approximately 0.07 inches. In one embodiment, the wall thickness is approximately 0.053 inches, and in another embodiment, the wall thickness is approximately 0.060 inches. Other wall thicknesses can be used in other embodiments.

In embodiments wherein a roof is provided over an enclosed area, such as illustrated in FIG. 22, the apex of the roof can be configured to extend 2 feet over the top of the wall panels. Other roof heights can be used in other embodiments by manipulating the inclination of the inclined roof support holders 228 and the length of the roof support members 222 (see FIGS. 18 and 19).

In one exemplary embodiment, the barrier system 100 is provided in a kit that includes the structural components described herein, such as the framing members and the opaque curtains, as well as an instruction sheet containing assembly and disassembly instructions for the barrier system. In one embodiment, the kit includes components required to construct a three-panel barrier, such as illustrated in FIGS. 1 through 5. In other embodiments, the kit includes components required to built smaller or larger barriers. The kit also optionally includes a distance measurement line that can be used to estimate the appropriate distances that the leg attachment assemblies 118 should be separated, thereby facilitating quick assembly of the barrier system. In such embodiments, the distance measurement line has a length that is approximately equal to the length of the opaque curtain. In one embodiment, the kit components can be stowed in a storage bag that is dimensioned to fit within the trunk of a car, and that is configured to be easily carried by a single person. For example, in one such embodiment, the storage bag has a length less than six feet, and in another such embodiment, the storage bag has a length less than five feet. As another example, in one such embodiment, the components of the kit weigh less than 50 pounds, and in another such embodiment, the components of the kit weigh less than 40 pounds.

Exemplary Applications.

As set forth above, the barrier system described herein can be used in a wide variety of applications. For example, the barrier system is particularly useful as a privacy screen by public safety entities, such as law enforcement agencies and fire departments, for purposes such as to preserve investigative areas, to restrict unauthorized access, and to provide privacy to persons involved at the scene of a public incident (such as an automobile accident or a crime scene). The barrier system can also be used by public utilities or construction agencies to shield work areas from public view, and to restrict access to work areas. In still other applications, the barrier system can be used to quickly provide a temporary enclosed and optionally covered area, such as an enclosed room, that can be used for a virtually unlimited number of applications. Exemplary applications include, but are not limited to, an area for conducting interviews, for reporting to media agencies, for conducting business or selling goods and/or services, for providing a cordoned off recreation area, and for providing a dining and/or cooking area.

The barrier system can also be used to provide wind abatement, to provide a covered storage area, and to cordon off areas surrounding items such as recreational vehicles, trailers, and tents. The utility of the barrier system in these and other applications is enhanced by the fact that the barrier system can be moved and constructed relatively quickly and easily by a single person.

SCOPE OF THE INVENTION

While the foregoing detailed description discloses several embodiments of the present invention, it should be understood that this disclosure is illustrative only and is not limiting of the present invention. It should be appreciated that the specific configurations and operations disclosed can differ from those described above, and that the methods described herein can be used in contexts other than the provision of privacy barriers.

I claim:

1. A portable barrier panel for providing privacy to a screened area, the portable barrier panel comprising:

a plurality of vertical support tubes having an elongate axis, a lower portion and an upper portion opposite the lower portion;

a plurality of elongate legs having an adjustable length, the elongate legs attached to the lower portion of the vertical support tubes, such that an angle $\alpha$ exists between the elongate leg and the vertical support tube axis, wherein the angle $\alpha$ is adjustable;

a top elbow assembly mounted on the upper portion of the vertical support tubes, the top elbow assembly having a side tube holder positioned in a substantially perpendicular configuration with respect to the vertical support tube axis, wherein the side tube holder can be rotated around the vertical support tube axis;

an elongate horizontal framing member having first and second ends, wherein the first and second ends are supported by side tube holders that form a part of top elbow assemblies that are mounted to two different vertical support tubes; and an opaque curtain mounted to the horizontal framing member and at least one of the vertical support tubes.

2. The portable barrier panel of claim 1, wherein three of the elongate legs are attached to one of the vertical support tubes.

3. The portable barrier panel of claim 1, wherein the vertical support tubes, the elongate legs, and the elongate horizontal framing member comprise powder-coated aluminum tubing.

4. The portable barrier panel of claim 1, further comprising a rubber cap positioned on at least one of the elongate legs opposite the vertical support tube.

5. The portable barrier panel of claim 1, wherein the angle $\alpha$ is capable of being adjusted to an angle of approximately 0° when the portable barrier panel is disassembled.

6. The portable barrier panel of claim 1, wherein the opaque curtain includes a plurality of wind vents configured to allow air to pass through the opaque curtain.

7. The portable barrier panel of claim 1, wherein the opaque curtain comprises a nylon sheet.

8. The portable barrier panel of claim 1, wherein the opaque curtain includes a substantially transparent window.

9. An apparatus comprising:

a frame that includes n horizontal framing members having first and second ends, and n+1 vertical support posts, wherein the vertical support posts are positioned to support the ends of the horizontal framing members, and wherein n is an integer greater than or equal to one;

a leg assembly mounted to and supporting each of the n+1 vertical support posts, the leg assembly having a plurality of elongate legs with an adjustable length, the elongate legs attached to the vertical support post such than an angle $\alpha$ exists between the elongate leg and the vertical support post, wherein the angle $\alpha$ is adjustable; and an opaque curtain supported by the frame.

10. The apparatus of claim 9, wherein n=3.

11. The apparatus of claim 9, further comprising n+1 top elbow assemblies mounted on the vertical support posts, the top elbow assemblies having a side tube holder configured to support the end of one of the a horizontal framing members.

12. The apparatus of claim 9, further comprising n+1 top elbow assemblies mounted on the vertical support posts, the top elbow assemblies having a side tube holder configured to support the end of one of the a horizontal framing members, wherein the side tube holder and the horizontal framing member mounted therein can be rotated around the vertical support post.

13. The apparatus of claim 9, wherein the vertical support posts, the elongate legs, and the horizontal framing members comprise powder-coated aluminum.

14. The apparatus of claim 9, further comprising a rubber cap positioned on at least one of the elongate legs opposite the vertical support post.

15. The apparatus of claim 9, wherein the angle $\alpha$ is capable of being adjusted to an angle of approximately 0°.

16. The apparatus of claim 9, wherein the opaque curtain includes a plurality of wind vents configured to allow air to pass through the opaque curtain.

17. A kit comprising:

a plurality of vertical support tubes having a lower portion and an upper portion, wherein a plurality of elongate legs are attached to the lower portion of the vertical support tubes at an adjustable angle, the elongate legs having an adjustable length;

a plurality of horizontal framing members configured to be mounted to the upper portion of the vertical support tubes, a plurality of opaque curtains configured to be at least partially supported by the horizontal framing members, such that the opaque curtains form a plurality of barrier panels that are rotatable with respect to each other;

an instruction sheet containing instructions for assembling the barrier panels; and a storage bag capable of holding the vertical support tubes, the horizontal framing members, and the instruction sheet.

18. The kit of claim 17, wherein the storage bag has a length that is less than six feet.

19. The kit of claim 17, wherein the storage bag has a weight that is less than fifty pounds when the vertical support tubes, the horizontal framing members, and the instruction sheet are placed therein.

20. The kit of claim 17, further comprising a distance measurement device having a length approximately equal to a length of the horizontal framing members.

21. The kit of claim 17, further comprising a plurality of top elbow assemblies configured to allow the horizontal framing members to be mounted to the vertical support tubes, such that the horizontal framing members can be rotated around the vertical support tubes.

22. A portable barrier system for providing an enclosed and covered area, the system comprising:

a plurality of enclosure side panels;

a plurality of vertical support posts that have a lower portion and an upper portion opposite the lower portion;

a plurality of elongate legs having an adjustable length, the elongate legs attached to the lower portion of the vertical support posts, such that an angle $\alpha$ exists between the elongate leg and the vertical support post, wherein the angle $\alpha$ is adjustable;

a top elbow assembly mounted on the upper support portion of the vertical support posts, the top elbow assembly having a side tube holder positioned in a substantially perpendicular configuration with respect to the vertical support post, and an inclined roof support holder positioned in an inclined orientation with respect to the side tube holder;

a roof support member that is supported by two inclined roof support holders, the roof support member forming a roof apex at an elevation above an elevation of the upper portion of the vertical support posts; and a flexible roofing material overlaying the roof support member and forming an enclosed and covered area within the enclosure side panels.

23. The portable barrier system of claim 22, further comprising at least three enclosure side panels, four vertical support posts, and two roof support members.

24. The portable barrier system of claim 22, further comprising two roof support members that are orthogonal to each other.

25. The portable barrier system of claim 22, further comprising two roof support members that are orthogonal to each other, and that intersect at the roof apex.

26. The portable barrier system of claim 22, wherein the enclosure side panels comprise a substantially transparent flexible window.

27. The portable barrier system of claim 22, wherein the roof support member comprises two lower roof support bars and two upper roof support bars, wherein each of the lower roof support bars are connected to one of the inclined roof support holders, and wherein the upper roof support bars are interconnected with a roof center support at the roof apex.

* * * * *